US008893617B2

(12) United States Patent
Muraoka

(10) Patent No.: US 8,893,617 B2
(45) Date of Patent: Nov. 25, 2014

(54) PRINTING METHOD AND TO-BE-PRINTED OBJECT

(75) Inventor: Kouji Muraoka, Fukui (JP)

(73) Assignee: Shuhou Co., Ltd., Fukui (JP)

( * ) Notice: Subject to any disclaimer, the term of this patent is extended or adjusted under 35 U.S.C. 154(b) by 364 days.

(21) Appl. No.: 13/256,662

(22) PCT Filed: Jan. 26, 2010

(86) PCT No.: PCT/JP2010/000409

§ 371 (c)(1),
(2), (4) Date: Sep. 15, 2011

(87) PCT Pub. No.: WO2010/113373

PCT Pub. Date: Oct. 7, 2010

(65) Prior Publication Data

US 2011/0315035 A1 Dec. 29, 2011

(30) Foreign Application Priority Data

Apr. 1, 2009 (JP) ..... 2009-089225
Jun. 16, 2009 (JP) ..... 2009-143480

(51) Int. Cl.

| | |
|---|---|
| ***B41F 17/34*** | (2006.01) |
| ***B41M 1/40*** | (2006.01) |
| ***B41F 17/00*** | (2006.01) |
| ***B41M 1/02*** | (2006.01) |
| ***B41M 1/10*** | (2006.01) |

(52) U.S. Cl.
CPC ..... *B41F 17/001* (2013.01); *B41M 1/02* (2013.01); *B41M 1/10* (2013.01)
USPC ..... 101/490; 101/35; 101/41

(58) Field of Classification Search
CPC ..... B41F 17/34; B41F 17/24; B41F 17/28; B41F 17/30; B41F 17/32; B41F 17/36; B41F 17/001; B41F 17/006; B41F 17/008; B41M 1/40; B41K 3/56
USPC ..... 101/490, 41, DIG. 30, 483, 35, 42, 163
IPC ..... B41F 17/34,17/24, 17/28, 17/30, 17/32, B41F 17/36; B41M 1/40; B41K 3/56
See application file for complete search history.

(56) References Cited

U.S. PATENT DOCUMENTS 5,855,658 A * 1/1999 Shimokuni ..... 106/31.65
6,158,341 A * 12/2000 Holmberg ..... 101/170

(Continued)

FOREIGN PATENT DOCUMENTS

CN 101007475 A 8/2007
CN 101014466 A 8/2007

(Continued)

OTHER PUBLICATIONS

Office Action dated Oct. 2, 2012 for the corresponding Korean Patent Application No. 10-2011-7021667.

(Continued)

*Primary Examiner* — Ren Yan
*Assistant Examiner* — Ruben Parco, Jr.
(74) *Attorney, Agent, or Firm* — Ladas & Parry LLP

(57) ABSTRACT

A printing method includes a step of dividing the to-be-printed surface 10 of a to-be-printed object 100 into a plurality of small to-be-printed surfaces 1*a*, 1*b*, . . . (a, b, . . . will be omitted below) and dividing a picture 20 to be printed on the to-be-printed surface 10 into small pictures 2 to be printed on the small to-be-printed surfaces 1, a step of a creating small developed picture 3 by developing each of the small pictures 2 into a plane, a step of putting ink on small printing original plate 30 corresponding to the small to-be-printed surface 1 according to the small developed picture 2, a step of a pressing small printing blanket 40 corresponding to each of the small to-be-printed surfaces 1 against the corresponding small printing original plate 30 and transferring the ink, and a step of printing the picture 20 on the to-be-printed surface 1 by pressing the small printing blanket 30 grasped by the arm of a multi-axis robot against the small to-be-printed surface 1 to print the small picture 2.

20 Claims, 16 Drawing Sheets

(56) References Cited

U.S. PATENT DOCUMENTS

| | | | | |
|---|---|---|---|---|
| 2004/0123753 | A1* | 7/2004 | Yoo et al. | 101/158 |
| 2006/0176517 | A1* | 8/2006 | Lima | 358/3.05 |

FOREIGN PATENT DOCUMENTS

| | | | | | |
|---|---|---|---|---|---|
| EP | 0 092 988 | A2 | | 11/1983 | |
| EP | 0 217 976 | A1 | | 4/1987 | |
| JP | 60-90761 | A | | 5/1985 | |
| JP | 2-301479 | A | | 2/1990 | |
| JP | 02-239972 | | | 9/1990 | |
| JP | 2-301479 | A | | 12/1990 | |
| JP | 11-268395 | A | | 10/1999 | |
| JP | 2005-125682 | A | | 5/2005 | |
| JP | 2008183833 | A | * | 8/2008 | B41M 1/40 |
| WO | 99/15334 | | | 4/1999 | |

OTHER PUBLICATIONS

Office Action dated Jun. 19, 2012 for Application No. JP2009-089225.

Office Action dated Jun. 19, 2012 Application No. JP 2009-143480 with English translation.

espacenet English abstract of JP 60-90761 A.

espacenet English abstract of JP 2-301479 A.

Supplementary European Search Report dated Mar. 27, 2013 for Application No. EP 10758159.7-1704.

Office Action dated Nov. 20, 2012 for the corresponding Japanese Patent Application No. 2009-143480 with English Translation.

English Patent Abstract of Japan 60-90761 A published May 21, 1985.

English Patent Abstract of Japan 2-301479 A published Dec. 13, 1990.

Patent Abstracts of Japan 2005-125682 A Published May 19, 2005 and Machine English Translation.

English Patent Abstract of Japan 11-268395 A published Oct. 5, 1999.

English Patent Abstract of Japan 02-239972 A published Sep. 21, 1990.

Non-English Office Action dated Apr. 8, 2013 for Application No. JP 201080014563.6 with English translation.

espacenet English abstract of CN 101014466 A.

espacenet English abstract of CN 101007475 A.

Non-English Office Action dated Nov. 20, 2013 for CN Application No. 201080014563.6 with English translation.

* cited by examiner (a)

(b)

(a)

(b)

PRINTING METHOD AND TO-BE-PRINTED OBJECT

TECHNICAL FIELD

The present invention relates to a printing method and a to-be-printed object and, more particularly, to a printing method in which a surface to be printed is divided into a plurality of areas and a to-be-printed object printed by the printing method.

BACKGROUND ART

Contrivances have been made to improve printing precision in pad printing, gravure printing, screen printing, and other types of printing. For example, the inventor of the present invention disclosed an invention in which a printing pad is combined with an original plate in a letterpress to improve printing precision and thereby to enable color printing in many colors (see Patent Literature 1, for example).

CITATION LIST

Patent Literature

Patent Literature 1: Japanese Unexamined Patent Application Publication No. 2-239972 (pages 8 and 9, FIG. 3)

SUMMARY OF INVENTION

Technical Problem

The invention disclosed in Patent Literature 1 has a significant advantage when printing is completed in one process for a flat surface or curved surface.

However, the to-be-printed object may have a complex shape; for example, a concave portion may be formed in the to-be-printed object, in which case, there has been the problem that it is hard to perform printing in the concave portion.

When printing is performed in several processes, for example, the northern hemisphere and south hemisphere of a spherical body are printed in different processes or the sides of a rectangular parallelepiped are printed in different processes, there has been a problem that an overlapping printed range is generated at the ends of the print areas (the equator of the spherical body or the edges of the rectangular parallelepiped), and the color tone in the overlapping range becomes dark.

The present invention addresses the above problems, and a first object thereof is to provide a printing method with which printing can be performed on a to-be-printed object having a complex shape (having a concave portion, for example).

A second object is to provide a printing method with which, when printing is performed on a plurality of divided print areas, even if an overlapping printed range is generated at the ends of the printed areas, the color tone of the overlapping range does not become dark. A third object is to obtain to-be-printed objects on which printing has been performed by using the printing methods described above.

Solution to Problem (1) A printing method according to the present invention is characterized by having a step of dividing the to-be-printed surface of a to-be-printed object into a plurality of small to-be-printed surfaces and dividing a picture to be printed on the to-be-printed surface into small pictures to be printed on the small to-be-printed surfaces, a step of creating a small developed picture by developing each of the small pictures into a plane, a step of putting ink on a small printing original plate corresponding to each of the plurality of small to-be-printed surfaces according to the small developed picture for a corresponding small to-be-printed surface of the small to-be-printed surfaces, a step of pressing a small printing blanket corresponding to each of the plurality of small to-be-printed surfaces against the small printing original plate to transfer the ink to the small printing blanket, and a step of printing the picture on the to-be-printed surface by pressing the small printing blanket against the corresponding small to-be-printed surface to print the small picture on the small to-be-printed surface.

(2) A printing method according to the present invention is characterized by having a step of dividing the to-be-printed surface of a to-be-printed object into a plurality of small to-be-printed surfaces so as to overlap boundaries of the small to-be-printed surfaces one another with a prescribed width and dividing a picture to be printed on the to-be-printed surface into small pictures to be printed on the small to-be-printed surfaces, a step of creating a small developed picture by developing each of the small pictures into planes, a step of putting ink on the small printing original plate corresponding to each of the plurality of small to-be-printed surfaces according to the small developed picture for a corresponding small to-be-printed surface of the small to-be-printed surfaces so that an amount of ink on an area between the boundaries with the prescribed width is less than an amount of ink on a range out of the area between the boundaries with the prescribed width, a step of pressing a small printing blanket corresponding to each of the plurality of small to-be-printed surfaces against the corresponding small printing original plate to transfer the ink to the small printing blanket, and a step of printing the picture on the to-be-printed surface by pressing each of the plurality of small printing blankets against the corresponding small to-be-printed surface to print the small picture on the small to-be-printed surface.

(3) A printing method according to the present invention is characterized by having a step of dividing the to-be-printed surface of a to-be-printed object into a plurality of small to-be-printed surfaces and dividing a picture to be printed on the to-be-printed surface into small pictures to be printed on the small to-be-printed surfaces, a step of creating small developed pictures by developing each of the small pictures into a plane, a step of putting ink on a small printing original plate corresponding to each of the plurality of small to-be-printed surfaces according to the small developed picture for the corresponding small to-be-printed surface, a step of pressing a small printing blanket corresponding to each of the plurality of small to-be-printed surfaces against the corresponding small printing original plate to transfer the ink to the small printing blanket, and a step of printing the picture on the to-be-printed surface by pressing the small printing blanket against the corresponding small to-be-printed surface to print the small picture on the small to-be-printed surface;

each of the plurality of small printing blankets is pressed against the corresponding small printing original plate in parallel to the normal line of the small printing original plate and is pressed against the corresponding small to-be-printed surface in parallel to the average normal line of the small to-be-printed surface.

(4) A printing method according to the present invention is characterized by having a step of dividing the to-be-printed surface of a to-be-printed object into a plurality of small to-be-printed surfaces so as to overlap boundaries of the small to-be-printed surfaces one another with a prescribed width and dividing a picture to be printed on the to-be-printed surface into small pictures to be printed on the small to-be-printed surfaces, a step of creating a small developed picture by developing each of the small pictures into a plane, a step of putting ink on small printing original plate corresponding to each of the plurality of small to-be-printed surfaces according to the small developed picture for a corresponding small to-be-printed surface of the small to-be-printed surfaces so that an amount of ink on an area between the boundaries with the prescribed width is less than an amount of ink on a range out of the area between boundaries with the prescribed width, a step of pressing a small printing blanket corresponding to each of the plurality of small to-be-printed surfaces against the corresponding small printing original plate to transfer the ink to the small printing blanket, and a step of printing the picture on the to-be-printed surface by pressing each of the plurality of small printing blankets against the corresponding small to-be-printed surface to print the small picture on the small to-be-printed surface;

each of the plurality of small printing blankets is pressed against the corresponding small printing original plate in parallel to the normal line of the small printing original plate and is pressed against the corresponding small to-be-printed surface in parallel to the average normal line of the small to-be-printed surface.

(5) In any one of (1) to (4) described above, the printing method is characterized in that the step of printing said picture is carried out using a multi-axis robot that stores a position of each of the plurality of small to-be-printed surfaces, sequentially grasps the small printing blanket corresponding to each of the plurality of small to-be-printed surfaces, and presses the grasped small printing blanket against the corresponding small to-be-printed surface.

(6) In any one of (1) to (4) described above, the printing method is characterized in that the step of printing the picture is carried out using a multi-axis robot that stores a position of each of the plurality of small to-be-printed surfaces, sequentially grasps the small printing blanket corresponding to each of the plurality of small to-be-printed surfaces, and presses the grasped small printing blanket against the corresponding small to-be-printed surface;

the small to-be-printed surface is a side or the bottom of a concave portion that is internally recessed in the to-be-printed object; and the small printing blanket corresponding to the side or bottom is insertable into the concave portion.

(7) In any one of (1) to (4) described above, the printing method is characterized in that the step of printing the picture is carried out using a multi-axis robot that stores a position of each of the plurality of small to-be-printed surfaces, sequentially grasps the small printing blanket corresponding to each of the plurality of small to-be-printed surfaces, and presses the grasped small printing blanket against the corresponding small to-be-printed surface;

the small to-be-printed surface is a side or the bottom of a concave portion that is internally recessed in the to-be-printed object; and a grasping part of said multi-axis robot that grasps said small printing blanket corresponding to said side or said bottom is insertable into the concave portion.

(8) A printing method according to the present invention is characterized by having a step of dividing a to-be-printed surface of a to-be-printed object into a plurality of small to-be-printed surfaces and dividing a picture to be printed on the to-be-printed surface into small pictures to be printed on the small to-be-printed surfaces, a step of creating a small developed picture by developing each of the small pictures into a plane, a step of putting ink on a small printing original plate corresponding to each of the plurality of small to-be-printed surfaces according to the small developed picture for the corresponding small to-be-printed surface, a step of pressing a small printing blanket corresponding to each of the plurality of small to-be-printed surfaces against the corresponding small printing original plate to transfer the ink to the small printing blanket, and a step of printing the picture on the to-be-printed surface by pressing each of the plurality of small printing blankets against the corresponding small to-be-printed surface to print the small picture on the small to-be-printed surface;

the step of printing a picture utilizes a lifting device that is raised and lowered with respect to a board on which the to-be-printed object is placed; and the lifting device grasps the small printing blanket corresponding to each of the plurality of small to-be-printed surfaces to press the small printing blanket against the corresponding small to-be-printed surface.

(9) A printing method according to the present invention is characterized by having a step of dividing a to-be-printed surface of a to-be-printed object into a plurality of small to-be-printed surfaces so as to overlap boundaries of the small to-be-printed surfaces one another with a prescribed width and dividing a picture to be printed on the to-be-printed surface into small pictures to be printed on the small to-be-printed surfaces, a step of creating a small developed picture by developing each of the small pictures into a plane, a step of putting ink on a small printing original plate corresponding to each of the plurality of small to-be-printed surfaces according to the small developed picture for the corresponding small to-be-printed surfaces so that an amount of ink on an area between the boundaries with the prescribed width is less than an amount of ink in a range out of the area between the boundaries with the prescribed width, a step of pressing a small printing blanket corresponding to each of the plurality of small to-be-printed surfaces against the corresponding small printing original plate to transfer the ink to the small printing blanket, and a step of printing the picture on the to-be-printed surface by pressing each of the plurality of small printing blankets against the corresponding small to-be-printed surface to print the small picture on the small to-be-printed surface;

the step of printing a picture utilizes a lifting device that is raised and lowered with respect to a board on which the to-be-printed object is placed; and the lifting device grasps the small printing blanket corresponding to each of the plurality of small to-be-printed surfaces to press the small printing blanket against the corresponding small to-be-printed surface.

(10) In (8) or (9) described above, the printing method is characterized in that the step of printing a picture utilizes a lifting device that is raised and lowered with respect to a board on which the to-be-printed object is placed, and when part of the picture is printed on a small to-be-printed surface positioned on a side of the to-be-printed object, the lifting device grasps the small printing blanket corresponding to the small to-be-printed surface and presses a part of the small printing blanket to which the ink has not been transferred against the board to press a part of the small printing blanket to which the ink has been transferred against the corresponding small to-be-printed surface.

(11) In (8) or (9) described above, the printing method is characterized in that the step of printing a picture utilizes a lifting device that is raised and lowered with respect to a board on which the to-be-printed object is placed, when part of the picture is printed on a small to-be-printed surface positioned on a side of the to-be-printed object, the lifting device grasps the small printing blanket corresponding to the small to-be-printed surface and presses a part of the small printing blanket to which the ink has not been transferred against the board to press a part of the small printing blanket to which the ink has been transferred against the corresponding small to-be-printed surface; and a range on the board against which the part of the small printing blanket to which the ink has not been transferred is pressed is on a lowering side in an elevation direction of the lifting device within a range of the board on which the to-be-printed object is placed.

(12) The to-be-printed object according to the present invention is characterized by having a to-be-printed surface printed by the printing method described in any one of (1), (2), (3), (4), (8), and (9).

Advantageous Effects of Invention (i) Since, in the printing method according to the present invention, a picture is printed on a to-be-printed surface by using small printing blankets corresponding to small pictures obtained by dividing a picture, printing on a to-be-printed object having a complex shape is possible. If directions in which a plurality of small printing blankets are pressed are made parallel to one another, a pressing operation become simple and a device used for the pressing operation can be simplified. In this case, the plurality of small printing blankets (each of which has a different shape) may be separately pressed one by one or some of the plurality of small printing blankets (each of which has a different shape) may be simultaneously pressed to a plurality of locations.

(ii) Since a picture is printed on a to-be-printed surface by using small printing blankets corresponding to small pictures divided so that their boundaries overlap one another with a prescribed width and by lessening the amount of ink in the overlapping prescribed width, printing on a to-be-printed object having a complex shape is possible and boundaries of small pictures are not darkened or a range in which there is no picture on the boundaries (in which the surface of the to-be-printed object appears as stripes) is not generated.

There is no limitation on the method of making a difference in the amount of ink; it suffices to make a difference in the number of halftone dots, the size of a halftone dot, or the amount of ink per unit area.

(iii) Since a plurality of small printing blankets are pressed parallel to the normal lines of the small printing original plates to which the small printing blankets correspond and parallel to the average normal line of the small to-be-printed surfaces to which the small printing blankets correspond, a precise picture can be printed.

(iv) Since a picture is printed by using a multi-axis robot that presses the small printing blankets against the small to-be-printed surfaces to which the small printing blankets correspond, a precise picture can be precisely printed on a to-be-printed object having a complex shape.

(v) Since the small printing blankets are insertable into a concave portion recessed in the to-be-printed object, a picture (or part of the picture) can be printed on a bottom or a side of the concave portion.

(vi) Since the small printing blankets and the grasping part of the multi-axis robot, which grasps them, are insertable into the concave portion, the small printing blanket can have an increased degree of freedom in its shape and a picture (or part of the picture) can be precisely printed on the bottom or the side of the concave portion.

(vii) Since, in the printing method according to the present invention, the step of printing a picture uses a lifting device that is raised and lowered (moved upward and downward) with respect to a board on which the to-be-printed object is placed, a device used in an operation can be simplified.

In this case, the plurality of small printing blankets (each of which has a different shape) may be separately attached to the lifting device one by one or some of the plurality of small printing blankets (each of which has a different shape) may be attached to a plurality of locations of the lifting device, The board or lifting device is equipped with horizontal moving means (which moves in the X and Y directions) for horizontal alignment between the to-be-printed object and the lifting device (which moves in the Z direction). Therefore, after horizontal alignment between the to-be-printed object and the lifting device has been completed by the horizontal moving means, lifting means is lowered. The horizontal positions relative to the board and lifting device may be changed in synchronization with the lowering of the lifting means. In this case, the to-be-printed object may be moved horizontally (in the X direction and Y direction), the lifting device may be moved horizontally (in the X direction and Y direction), or both the to-be-printed object and lifting device may be moved horizontally (in the X direction and Y direction).

(viii) Since when part of the picture is printed on a small to-be-printed surface positioned on a side of the to-be-printed object, the lifting device presses a part, on the small printing blanket, to which the ink has been transferred against the small to-be-printed surface to which the small printing blanket corresponds by pressing a part, on the small printing blanket, to which the ink has not been transferred against the board, printing is possible on, for example, a side substantially perpendicular to the board or a side that is more outside the to-be-printed object as the side is more distant from the board (a side in a so-called overhang state).

When the lifting means is lowered to a prescribed vertical position (including a case in which the small printing blanket is pressed against the board by a prescribed distance) for horizontal alignment between the to-be-printed object and the lifting device (which moves in the Z direction) by using the horizontal moving means (which moves in the X direction and Y direction) attached to the board or lifting device, the lifting device may be moved close to the to-be-printed object (or may be pressed against the to-be-printed object). Furthermore, the horizontal moving means may move the lifting device close to the to-be-printed object (may press the lifting device against the to-be-printed object) in the horizontal direction, in synchronization with the lowering of the lifting means.

(ix) Since the range on the board against which the part, on the small printing blanket, to which the ink has not been transferred is pressed is one step lower in the elevation direction of the lifting device than the range of the board on which the to-be-printed object is placed, when the small printing blanket is pressed against the one-step-lower range, the surface of the part, on the small printing blanket, to which the ink has been transferred tends to deform (expand) in a direction more parallel to the surface of the board, improving the precision of printing on the small to-be-printed surface (side).

(x) Since the to-be-printed object according to the present invention is characterized by having a to-be-printed surface printed by a printing method having the effect described in any one of (i) to (ix), a precise picture is printed on the entire surface of a complex shape or on part of the entire surface.

DESCRIPTION OF EMBODIMENTS

[Embodiment 1]

Figure 1:
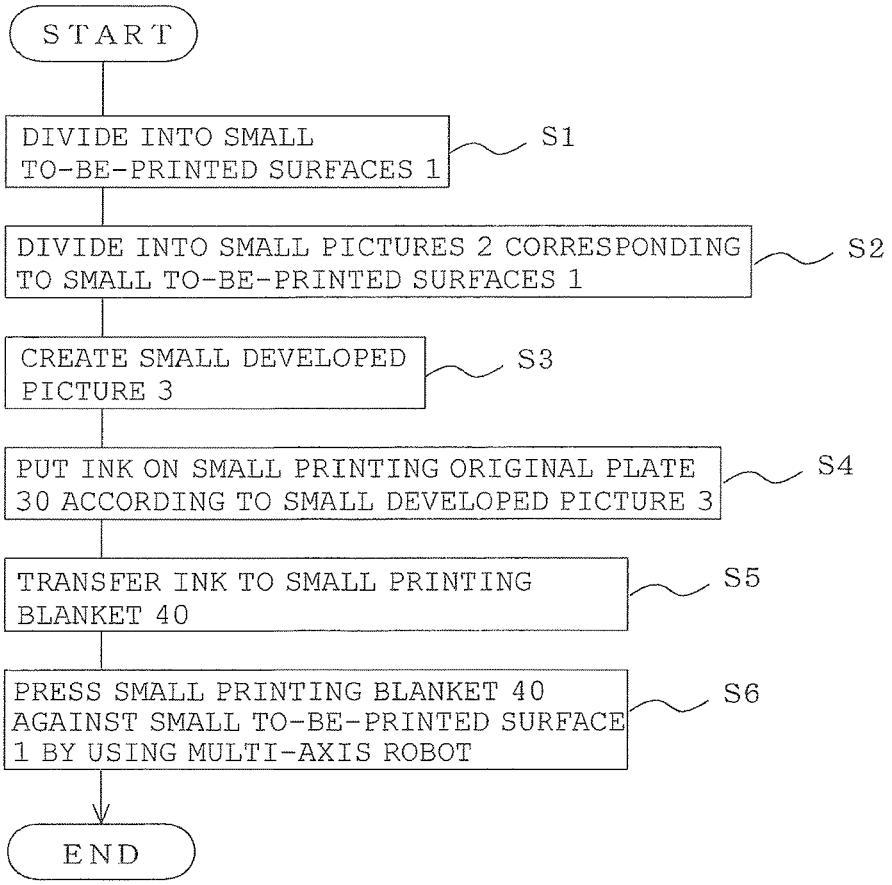
FIG. 1 is a flowchart illustrating a printing method according to Embodiment 1 of the present invention.
Figure 2:
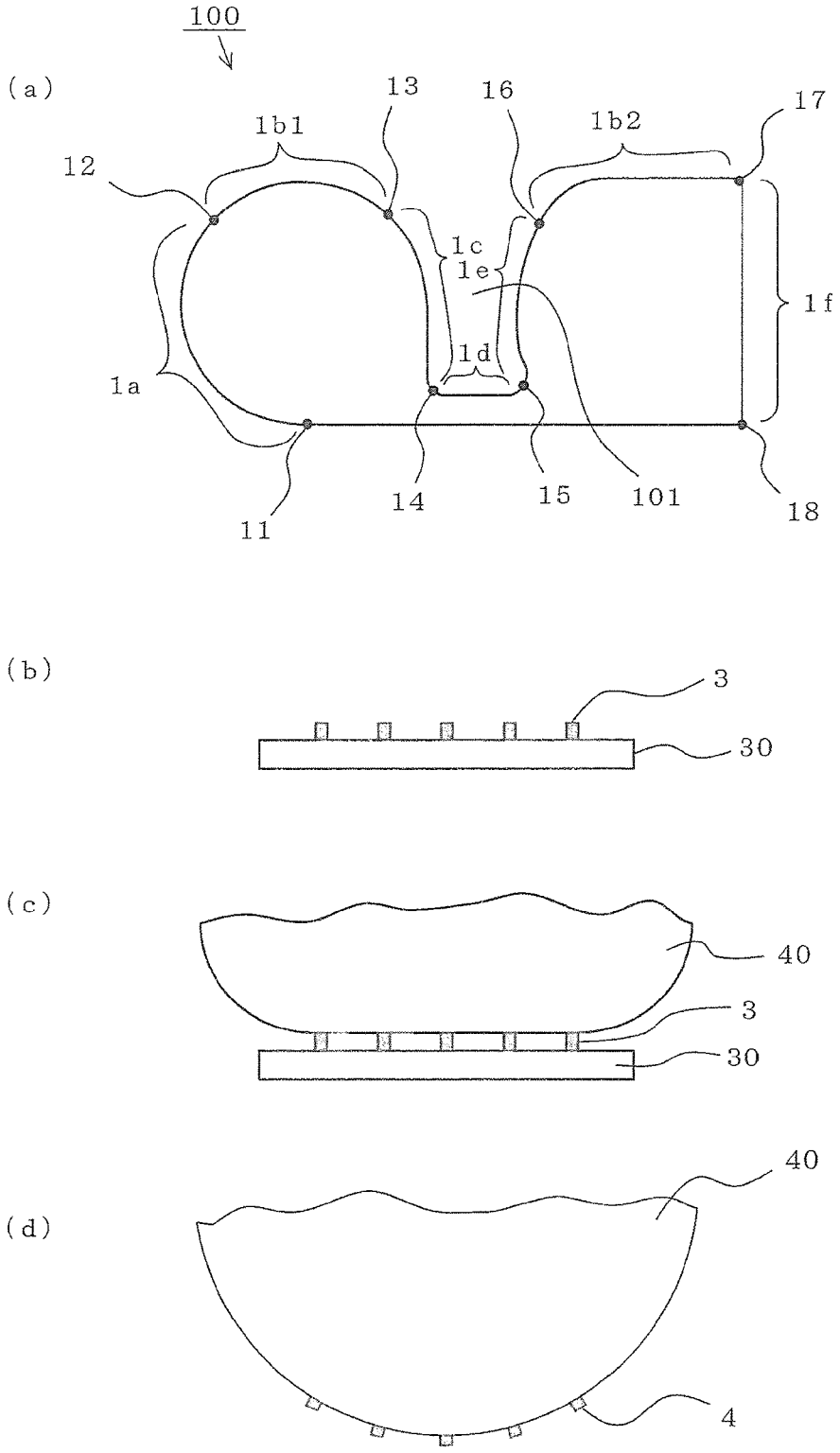
FIG. 2 shows cross sections that illustrate the printing method according to Embodiment 1 of the present invention in individual printing processes.
Figure 3:
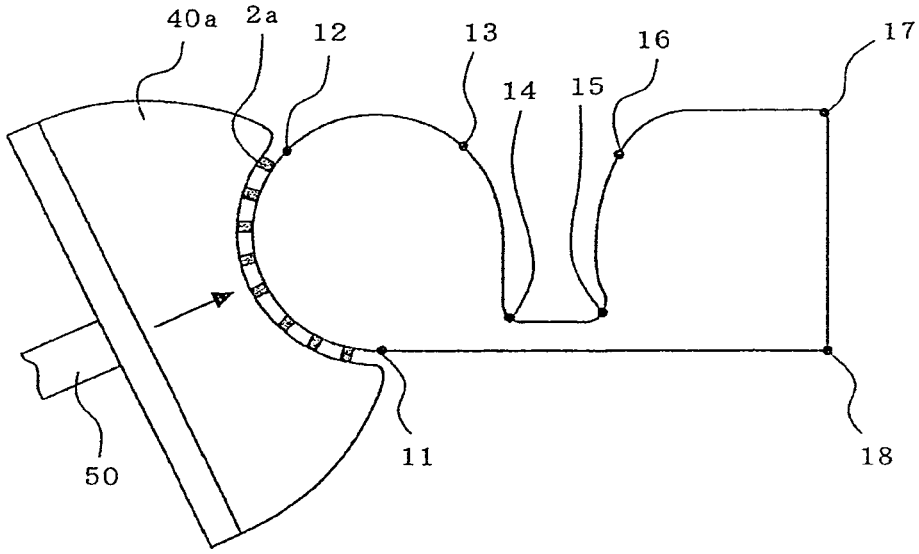
FIG. 3 shows cross sections that illustrate the printing method according to Embodiment 1 of the present invention in individual printing processes.
Figure 3:
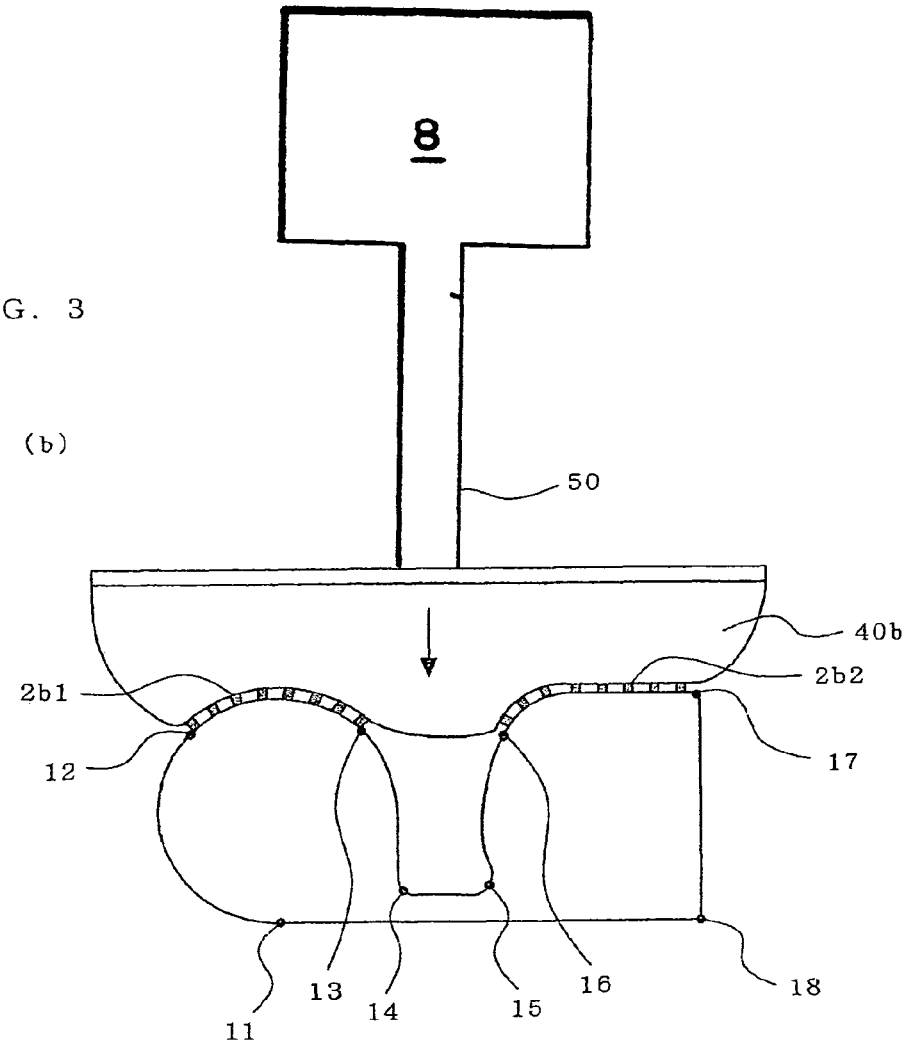
Figure 4:
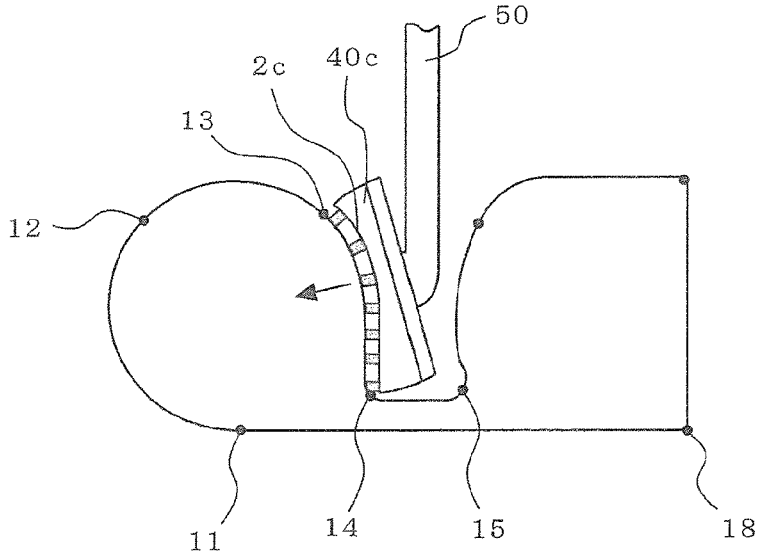
FIG. 4 shows cross sections that illustrate the printing method according to Embodiment 1 of the present invention in individual printing processes.
Figure 4:
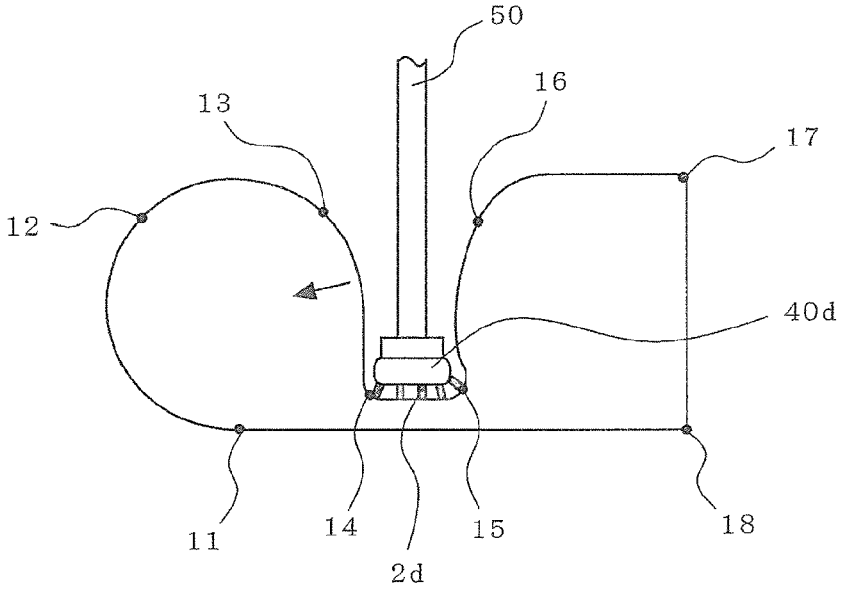

FIGS. 1 to 4 illustrate a printing method according to Embodiment 1; FIG. 1 shows a flowchart and FIGS. 2 to 4 show cross sections in individual printing processes. FIGS. 2 to 4 each schematically exaggerate part of the cross section, and the present invention is not limited in terms of the shape of the to-be-printed object and the form (shape, distribution, and the like) of a picture (ink) to those shown in the drawings. For common elements in the description that follows, subscripts such as a, b, c, attached to reference signs may be omitted, In FIG. 2(*a*), the to-be-printed surface 10 (from a position 11 to a position 18) of a to-be-printed object 100 is divided into a plurality of small to-be-printed surfaces 1*a*, 1*b*1, 1*b*2, . . . , and, 1*f* (each small to-be-printed surface will be referred to below as the small to-be-printed surface 1)(S1 in FIG. 1), and a picture 20 (not shown) to be printed on the to-be-printed surface 10 is divided into small pictures 2*a*, 2*b*1, 2*b*2, . . . , and, 2*f* (each small picture will be referred to below as the small picture 2), each of which is printed on a pertinent small to-be-printed surface 1 (S2 in FIG. 1).

The small pictures 2 are developed into planes to form small developed pictures 3*a*, 3*b*1, 3*b*2, and, 3*f* (each small developed picture will be referred to below as the small developed picture 3) (S3 in FIG. 1).

In FIG. 2(*b*), ink is put on small printing original plate 30*a*, 30*b*, . . . , or 30*f* (hereinafter referred to as the small printing original plate 30, respectively) corresponding to the small to-be-printed surfaces 1 according to the small developed pictures 3 on the corresponding small to-be-printed surfaces 1 (S4 shown in FIG. 1).

At this time, ink is put on the small printing original plate 30*b* according to the small developed pictures 3*b*1 and 3*b*2. There is no limitation on the method of putting the ink. The ink may be put on the convex portions of a letterpress printing plate or the concave portions of an intaglio plate on which the small developed picture 3 is formed; alternatively, the ink may be put on a flat plate by printing (such as an ink jet printer, screen printing, gravure printing, or offset printing).

In FIG. 2(*c*), small printing blankets 40*a*, 40*b*, . . . , and, 40*f* (each small printing blanket will be referred to below as the small printing blanket 40) corresponding to each small to-be-printed surfaces 1 are pressed against the corresponding small printing original plates 30 to transfer the ink to the small printing blankets 40 (step S5 in FIG. 1).

At this time, each small printing blanket 40 is pressed in parallel to the normal line of the small printing original plate 30. A multi-axis robot may be used to press the small printing blankets 40 against their corresponding small printing original plates 30.

In FIG. 2(*d*), when the small printing blanket 40 is separated after it has been pressed, ink adheres to the small printing blanket 40 along one of small printing blanket pictures 4*a*, 4*b*, and, 4*f* (each small printing blanket picture will be referred to below as the small printing blanket picture 4) that corresponds to the small developed pictures 3.

In FIG. 3(*a*), the small printing blanket 40*a* is pressed against its corresponding small to-be-printed surface 1*a* to print the small picture 2*a* thereon (S6 in FIG. 1).

At this time, the small printing blanket 40*a* is grasped by an arm 50 of the multi-axis robot 8 (shown diagrammatically in FIG. 3(*b*)), precisely positioned, and pressed in parallel to the normal line (indicated by the arrow) substantially at the center of the small to-be-printed surface 1*a*.

In FIG. 3(*b*), the small printing blanket 40*b* is pressed against its corresponding small to-be-printed surfaces 1*b*1 and 1*b*2 to print the small pictures 2*b*1 and 2*b*2 thereon (S6 in FIG. 1).

At this time, the small printing blanket 40*b* is grasped by the arm 50 of the multi-axis robot 8, precisely positioned, and pressed parallel to the normal line substantially at the center of the small to-be-printed surface 1*b*1 and the normal line substantially at the center of the small to-be-printed surface 1*b*2 or a line (indicated by the arrow) at the intermediate position between both normal lines.

In FIG. 4(*a*), the small printing blanket 40*c* is pressed against its corresponding small to-be-printed surface 1*c* to print the small picture 2*c* thereon (S6 in FIG. 1).

At this time, the small printing blanket 40*c* is grasped by the arm 50 of the multi-axis robot (not shown), enters a concave portion 101 in the to-be-printed object 100, is precisely positioned, and is pressed parallel to the normal line (indicated by the arrow) substantially at the center of the small to-be-printed surface 1*c*.

Although, in FIG. 4(*a*), the top of the arm 50 that grasps the small printing blanket 40*c* enters the concave portion 101, the present invention is not limited to this; part (the upper portion in the drawing) of the small printing blanket 40*c* may be grasped and the top of the arm 50 may not enter the concave portion 101.

In FIG. 4(*b*), the small printing blanket 40*d* is pressed against its corresponding small to-be-printed surface 1*c* to print the small picture 2*c* thereon (S6 in FIG. 1).

At this time, the small printing blanket 40*d* is grasped by the arm 50 of the multi-axis robot (not shown), enters the concave portion 101 in the to-be-printed object 100, is precisely positioned, and is pressed parallel to the normal line (indicated by the arrow) substantially at the center of the small to-be-printed surface 1*d*.

Similarly, the small printing blankets 40*e* and 40*f* are pressed against their corresponding small to-be-printed surfaces 1*e* and 1*f* to print the small pictures 2*e* and 2*f* thereon.

Therefore, the picture 20 is printed on the to-be-printed surface 10 of the to-be-printed object 100 by printing the series of small pictures 2. At that time, the small pictures 2 are also printed on the concave portion 101 while precise positioning is being carried out by the arm 50 of the multi-axis robot.

Although, in the above description, the small printing blankets 40 are individually grasped and the small pictures 2 are separately printed, a plurality of arms may be used to print the plurality of small pictures 2 substantially at the same time. There is no limitation on the order in which the small pictures 2 are printed.

In the present invention, the use of a multi-axis robot is not a limitation. For example, means having a positioning function and a pressing function may be used instead of a multi-axis robot, or positioning mechanisms may be provided on the small printing blankets 40 or the like to manually press the small printing blankets 40.

[Embodiment 2]

Figure 5:
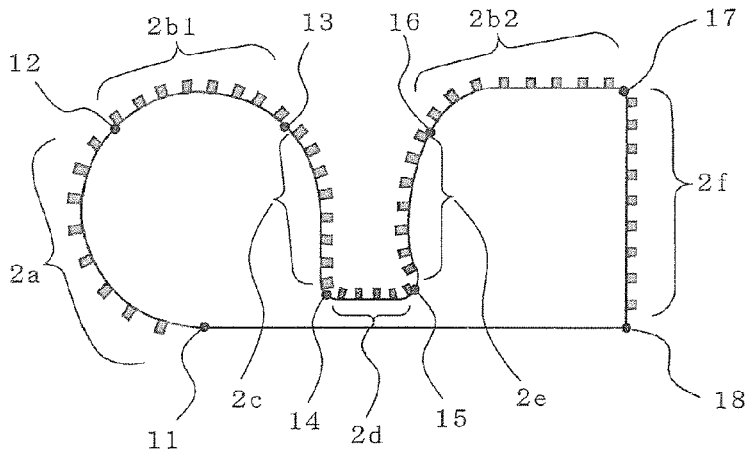
FIG. 5 schematically shows the cross section of a to-be-printed object according to Embodiment 2 of the present invention.

FIG. 5 schematically shows the cross section of a to-be-printed object according to Embodiment 2 of the present invention. The same elements as in Embodiment 1 are assigned the same reference signs and their description is partially omitted.

The printed material 200 in FIG. 5 is identical to the to-be-printed object 100 on which the pictures 20 have been printed by the printing method described in Embodiment 1. That is, the small pictures 2*c*, 2*d*, and 2*e*, which are part of the pictures 20, have been also printed on the concave portion 101.

[Embodiment 3]

Figure 6:
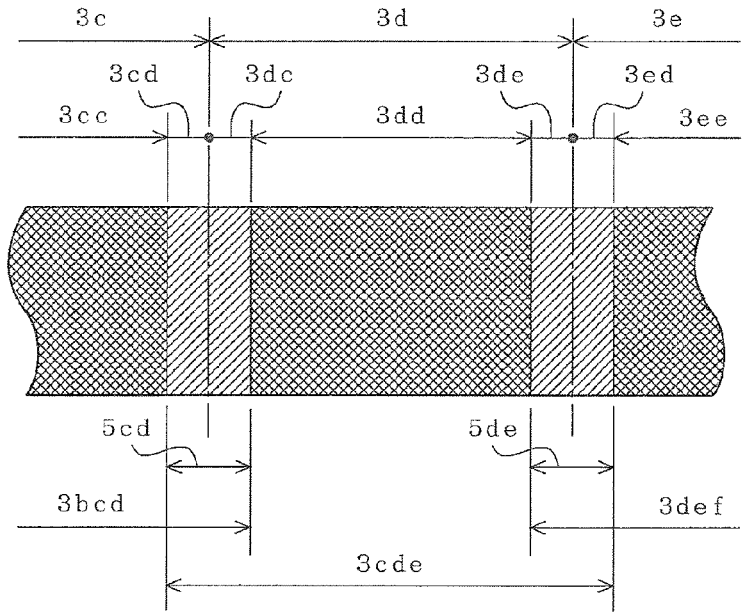
FIG. 6 shows a plan view that illustrates a procedure for dividing a picture in a printing method according to Embodiment 3 of the present invention.
Figure 7:
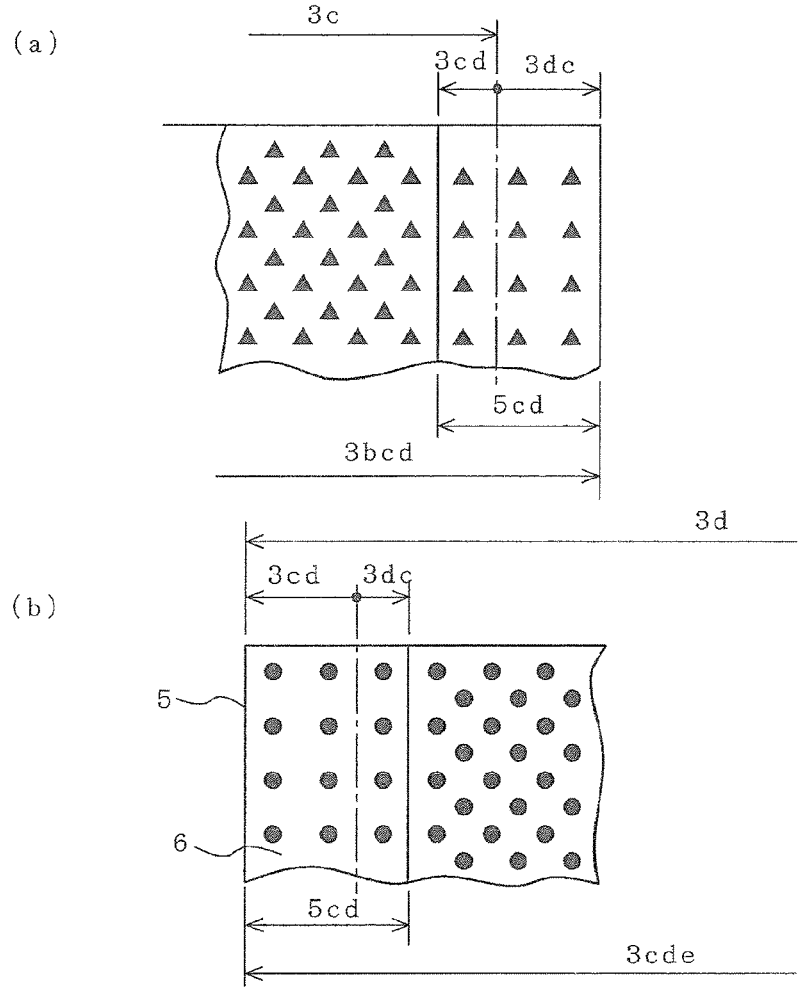
FIG. 7 shows enlarged plan views that schematically illustrate examples of halftone dot arrangements of small developed pictures in the printing method in FIG. 6.
Figure 8:
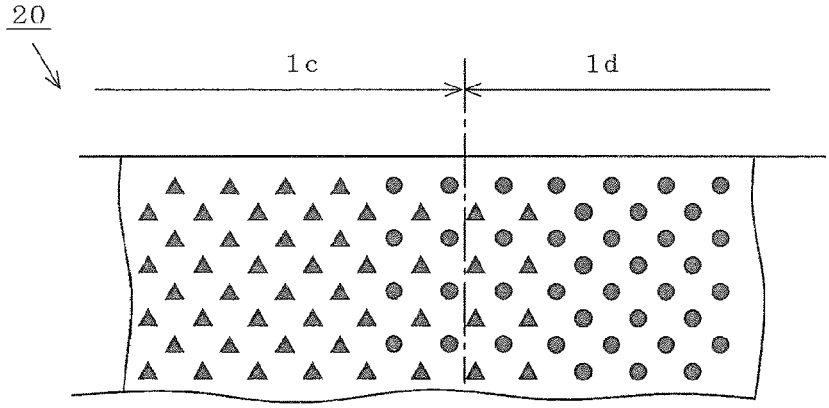
FIG. 8 shows an enlarged plan view that schematically illustrates an overlapping printed range in the printing method in FIG. 6.

FIGS. 6 to 8 illustrate a printing method according to Embodiment 3 of the present invention; FIG. 6 schematically shows a plan view that illustrates a procedure for dividing a picture, FIG. 7 shows enlarged plan views that schematically illustrate an example of halftone dot arrangements in small developed pictures, and FIG. 8 shows an enlarged plan view that schematically illustrates an overlapping printed range. FIGS. 6 to 8 are schematic drawings, and the present invention is not limited in terms of the shape of the to-be-printed object and the form (shapes, distribution, and the like) of halftone dots to those shown in the drawings. The same parts as or equivalent to those in Embodiment 1 are assigned the same reference signs and their descriptions are partially omitted.

In FIGS. 6 to 8, the to-be-printed surface 10 of the to-be-printed object 100 is divided into a plurality of small to-be-printed surfaces . . . , 1*c*, 1*d*, 1*e*, . . . so that their boundaries overlap one another with a prescribed width (equivalent to S1 in FIG. 1), and the picture 20 (not shown) to be printed on the to-be-printed surface 10 is divided into small pictures . . . , 2*c*, 2*d*, 2*d*, . . . , each of which is printed on a pertinent small to-be-printed surface 1 (equivalent to S2 in FIG. 1).

The small pictures . . . , 2*c*, 2*d*, 2*e*, . . . , are developed into planes to form small developed pictures . . . , 3*c*, 3*d*, 3*e*, . . . , (equivalent to S3 in FIG. 1).

Then, ink is put on small printing original plates . . . , 30*c*, 30*d*, 30*e*, . . . corresponding to small to-be-printed surfaces . . . , 1*c*, 1*d*, 1*e*, . . . according to the small developed pictures . . . , 3*c*, 3*d*, 3*e*, . . . for the corresponding small printing original plate respectively (equivalent to S4 in FIG. 1).

At this time, ink is put on, for example, the small printing original plate 30*c* according to an enlarged small developed picture 3*bcd*, which is added with a boundary range 3*dc* equivalent to a prescribed width in contact with the small developed picture 3*d* of the small developed picture 3*c*, to a range equivalent to the small developed picture 3*c*.

The amount of ink to be put on an overlapping range 5*cd*, which is a combination of a boundary range 3*cd*, equivalent to a prescribed width over which the small developed picture 3*c* comes into contact with the small developed picture 3*d*, and the boundary range 3*dc*, equivalent to the prescribed width over which the small developed picture 3*d* comes into contact with the small developed picture 3*c*, is smaller than the amount of ink to be put on an inner range 3*cc*, which is obtained by excluding the overlapping range 5*cd* from a range equivalent to the enlarged small developed picture 3*bcd* (see FIG. 7(*a*)).

Similarly, ink is put on, for example, the small printing original plate 30*d* according to a range equivalent to an enlarged small developed picture 3*cde*, which is added with the boundary range 3*cd* equivalent to the prescribed width in contact with the small developed picture 3*c* of the small developed picture 3*d* and the boundary range 3*ed* equivalent to the prescribed width in contact with the small developed picture 3*e* of the small developed picture 3*d* to a range equivalent to the small developed picture 3*d*.

The amount of ink to be put on the overlapping range 5*cd* and the amount of ink to be put on an overlapping range 5*de*, which is a combination of a boundary range 3*de*, equivalent to a prescribed width over which the small developed picture 3*d* comes into contact with the small developed picture 3*e*, and the boundary range 3*ed*, equivalent to the prescribed width over which the small developed picture 3*e* comes into contact with the small developed picture 3*d*, are smaller than the amount of ink to be put on an inner range 3*dd*, which is obtained by excluding the overlapping range 5*cd* and the overlapping range 5*de* from a range equivalent to the enlarged small developed picture 3*cde* (see FIG. 7(*b*)).

That is, the number of halftone dots in, for example, the overlapping range 5*cd* is smaller than those in the inner range 3*cc* and the inner range 3*dd*.

Alternatively, the halftone dot distribution (the density in per unit area) in the overlapping range 5*cd* is gradually decreased as the distance from the inner range 3*cc* and the inner range 3*dd* becomes longer. Alternatively, the size of each halftone dot in the overlapping range 5*cd* is smaller than that in the inner range 3*cc* and the inner range 3*dd*. Alternatively, the size of each halftone dot in the overlapping range 5*cd* is gradually decreased as the distance from the inner range 3*cc* and the inner range 3*dd* becomes longer. There is no limitation in the method of putting the ink, as in Embodiment 1.

Furthermore, as in Embodiment 1, the ink is transferred to the small printing blankets . . . , 40*c*, 40*d*, 40*e*, . . . , so that the ink adheres to them along the small printing blanket pictures . . . , 4*c*, 4*d*, 4*e*, . . . , (equivalent to step S5 in FIG. 1).

Next, the small printing blankets . . . , 40*c*, 40*d*, 40*e*, . . . , are pressed against their corresponding small to-be-printed surfaces . . . , 1*c*, 1*d*, 1*e*, . . . , to print small pictures . . . , 2*c*, 2*d*, 2*e*, . . . thereon (equivalent to S6 in FIG. 1).

Then, for example, the prescribed widths of the small picture 2*c* and 2*d* at their boundaries overlap each other, the prescribed widths of the small picture 2*d* and 2*e* at their boundaries overlap each other, and the amount of ink in each overlapping range is less than the amount of ink in the inner ranges, in which the overlapping range is excluded, so the picture in the overlapping range is not darkened (see FIG. 8).

In this case, if, for example, the amount of ink to be put on a range equivalent to the overlapping range 5*cd* on the small developed picture 3*d* is reduced by $\alpha$ % on the small printing original plate 30*c* and the amount of ink to be put on a range equivalent to the overlapping range 5*cd* on the small developed picture Sc is reduced by $(100-\alpha)$% on the small printing original plate 30*d*, the picture in the two overlapping ranges 5*cd* is neither darkened nor thinned, preventing the appearance from being impaired.

[Embodiment 4]

Figure 9:
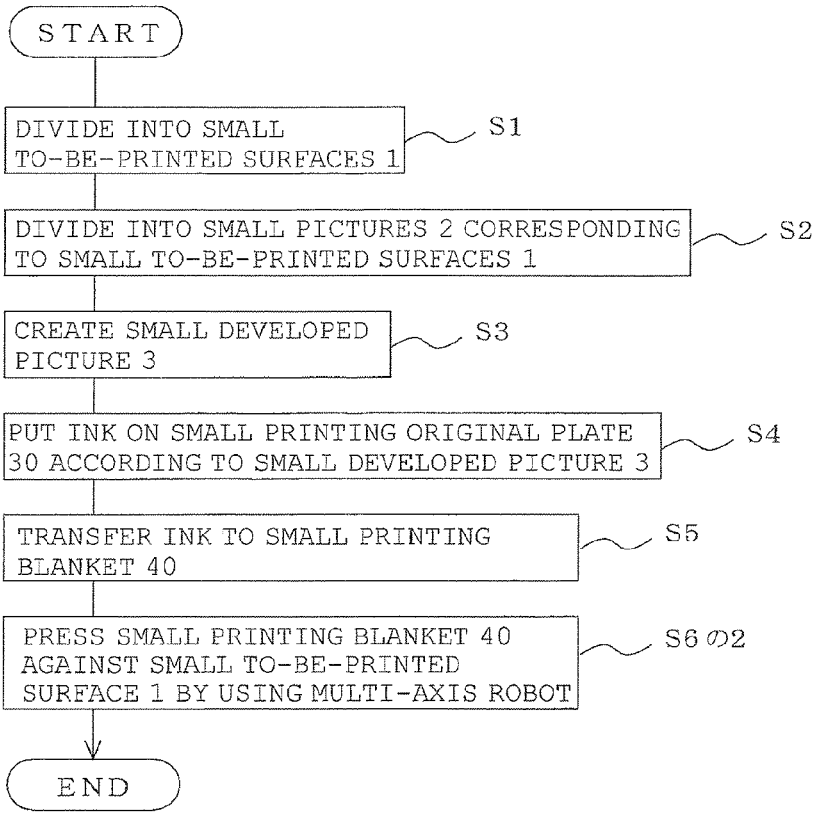
FIG. 9 is a flowchart illustrating a printing method according to Embodiment 4 of the present invention.
Figure 12:
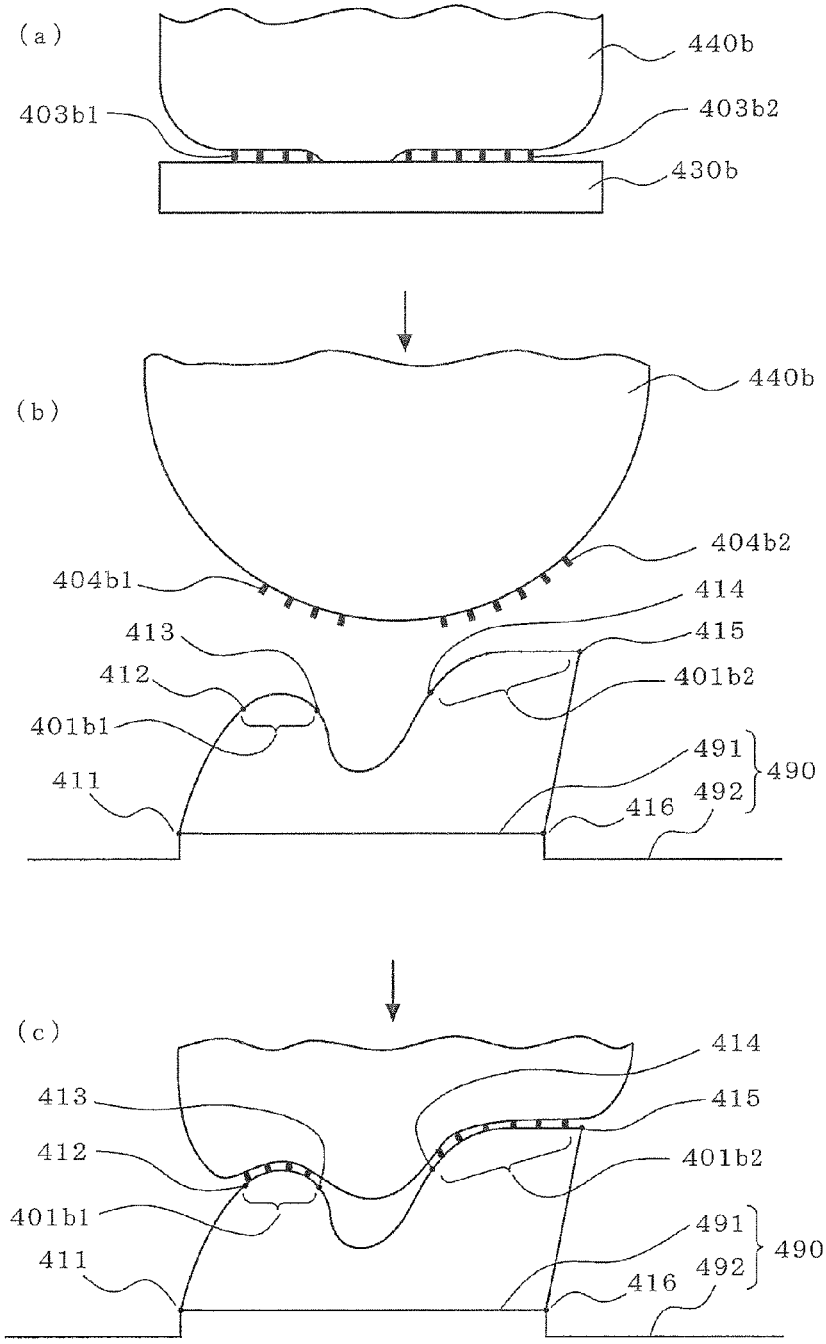
FIG. 12 shows cross sections that illustrate the printing method in FIG. 9 in individual printing processes.
Figure 13:
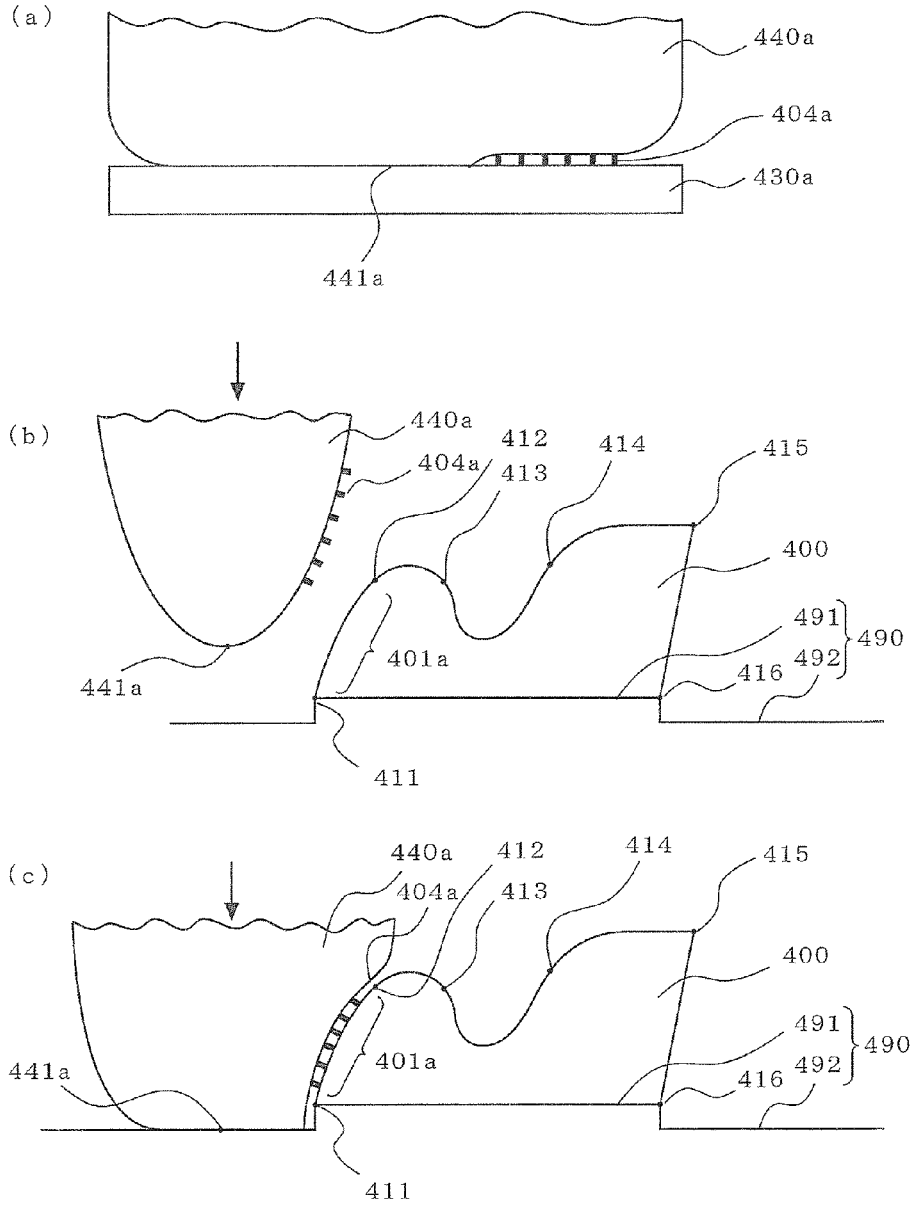
FIG. 13 shows cross sections that illustrate the printing method in FIG. 9 in individual printing processes.
Figure 14:
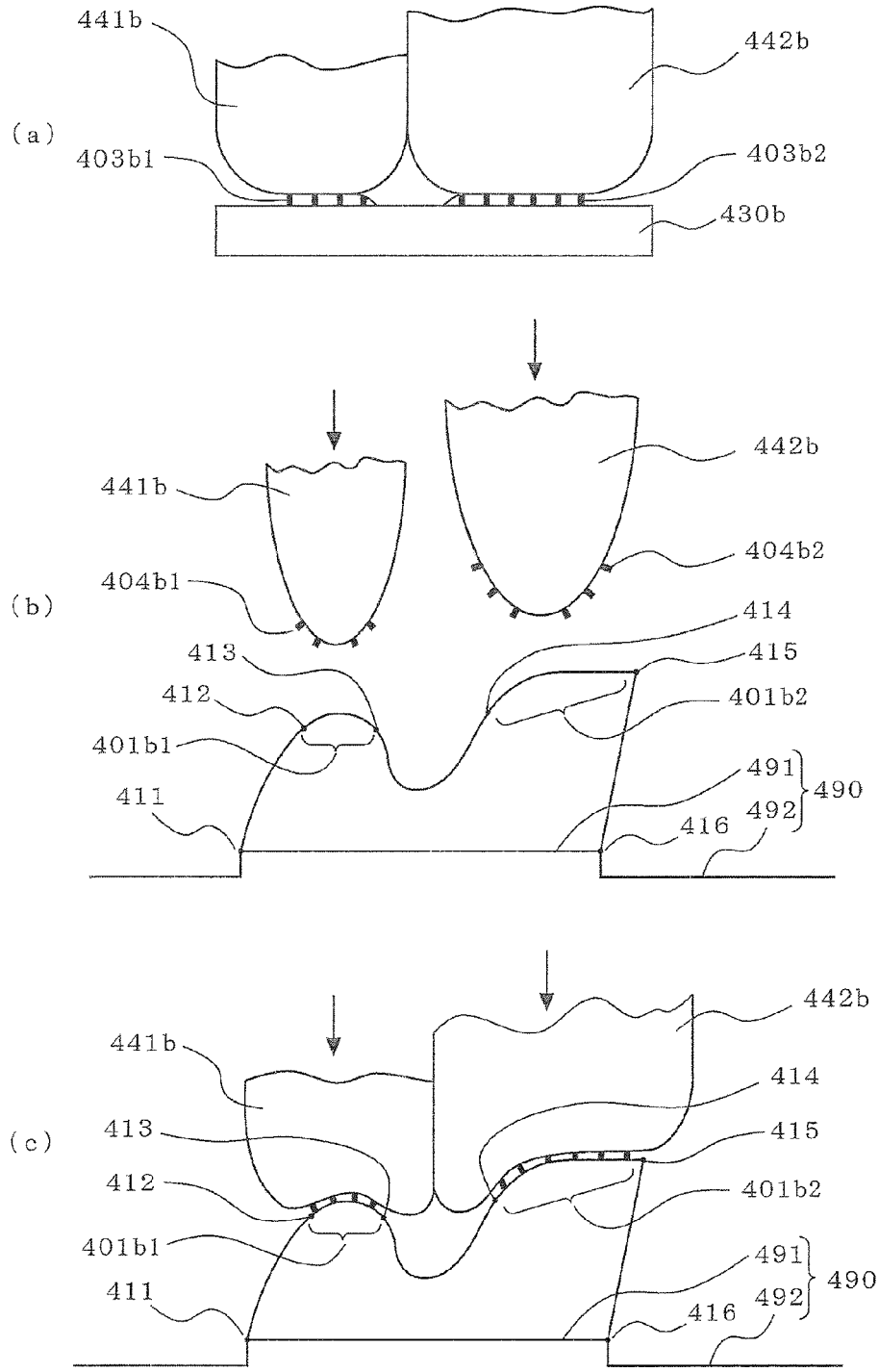
FIG. 14 shows cross sections that illustrate variations of the printing method in FIG. 12.
Figure 15:
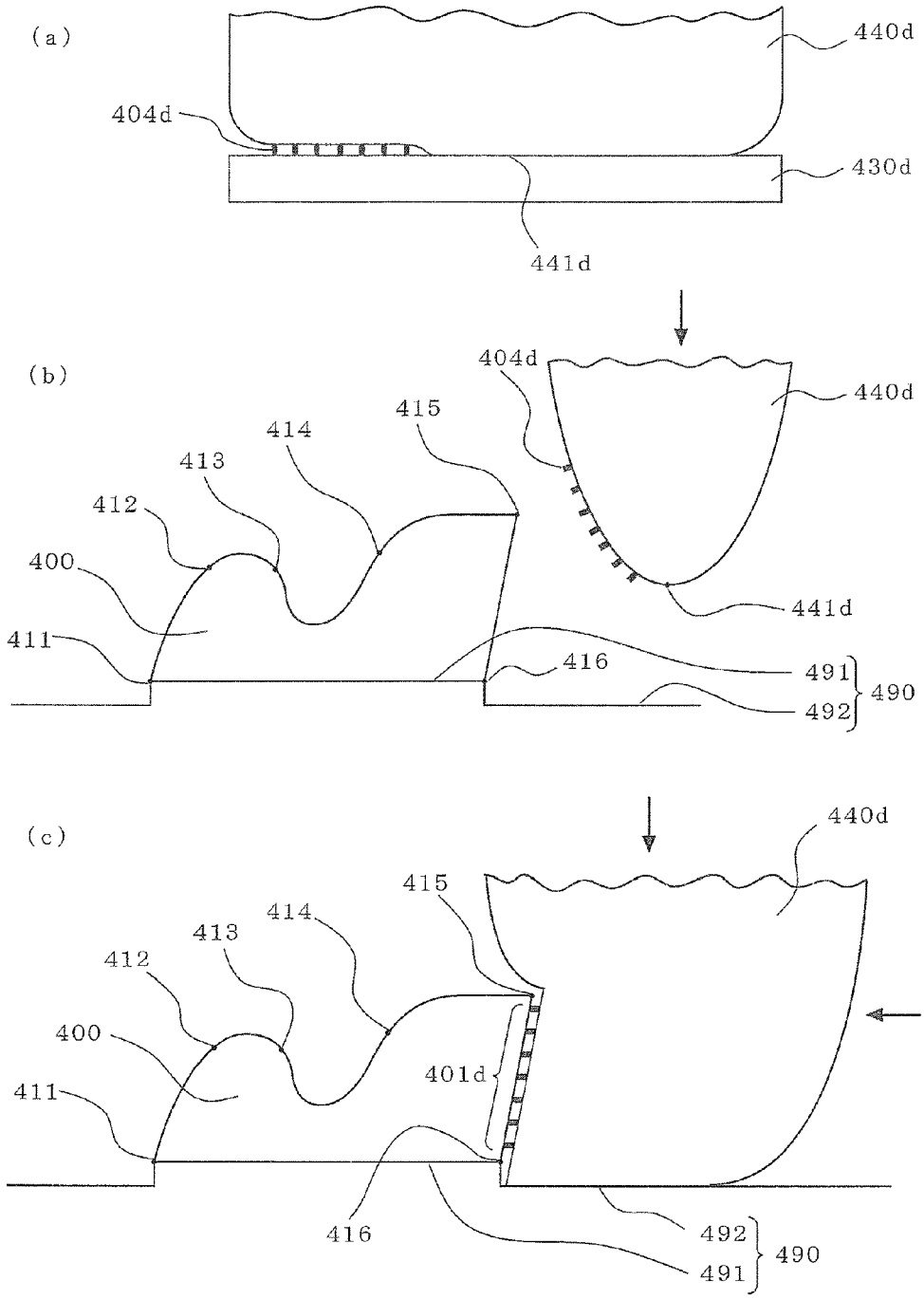
FIG. 15 shows cross sections that illustrate variations of the printing method in FIG. 13.
Figure 16:
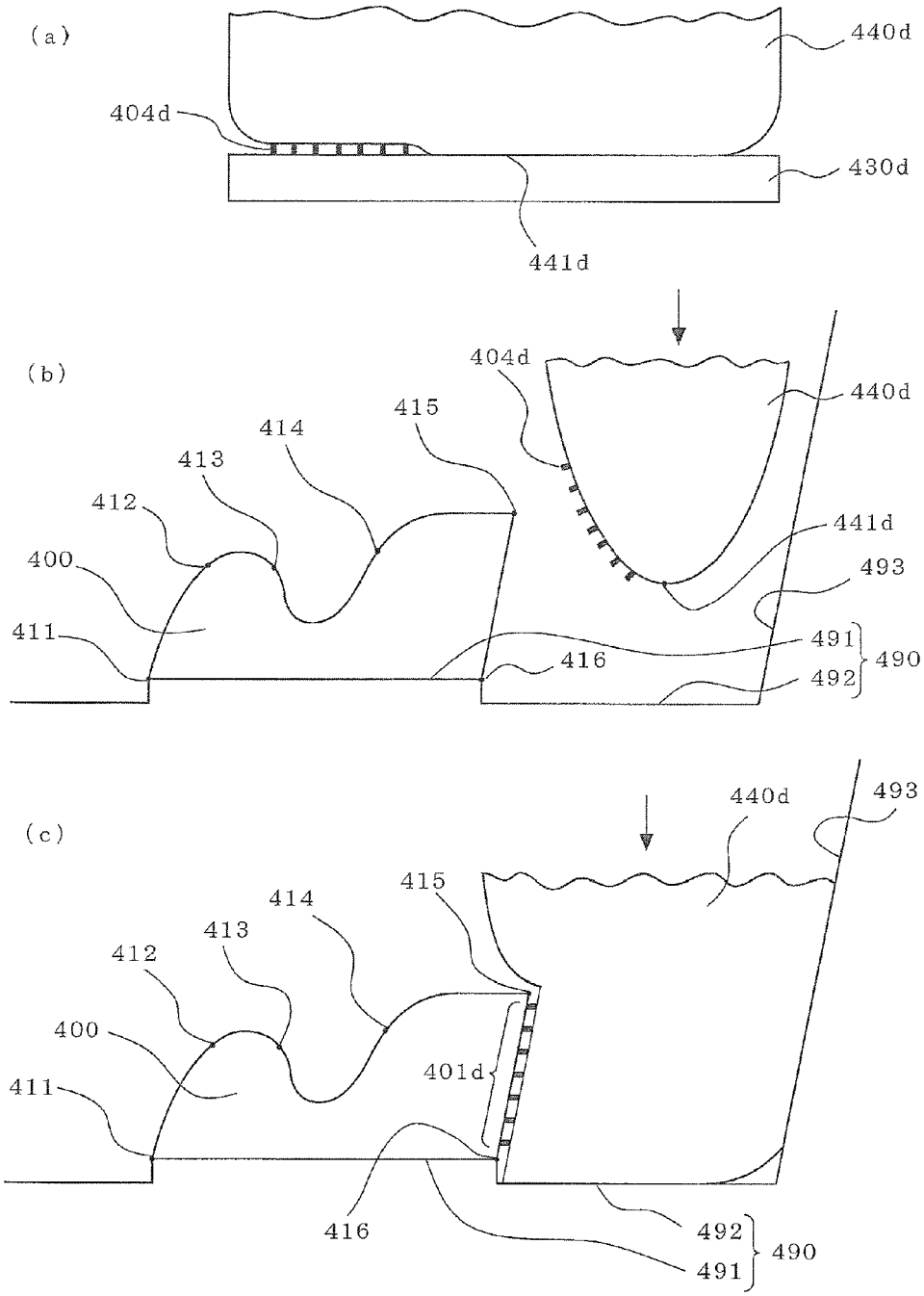
FIG. 16 shows cross sections that illustrate variations of the printing method in FIG. 13.

FIGS. 9 to 16 illustrate a printing method according to Embodiment 4; FIG. 9 shows a flowchart, FIGS. 10 to 13 show cross sections in individual printing processes, and FIGS. 14 to 16 show cross sections that illustrate variations of the printing method. FIGS. 10 to 16 each schematically exaggerate part of the cross section, and the present invention is not limited in terms of the shape of the to-be-printed object and the form (shape, distribution, and the like) of a picture (ink) to those shown in the drawings. For common elements in the description that follows, subscripts such as a, b, c, . . . attached to reference signs may be omitted.

In FIG. 9, the printing method in Embodiment 4 includes a step (S1) in which the to-be-printed surface 410 of a to-be-printed object 400 is divided into a plurality of small to-be-printed surfaces, a step (S2) in which a picture to be printed on the to-be-printed surface is divided into small pictures, each of which is printed on a pertinent small to-be-printed surface, a step (S3) in which each small picture is developed into a plane to form a small developed picture, a step (S4) in which ink is put on each small printing original plate corresponding to a pertinent small to-be-printed surface, according to the corresponding small developed picture for the small to-be-printed surface, a step (S5) in which a small printing blanket corresponding to a pertinent small to-be-printed surface is pressed against a corresponding printing original plate to transfer the ink to the printing original plate, and a step (S6-2) in which the small printing blanket is pressed against its corresponding small to-be-printed surface by using a lifting means, to print the small picture thereon.

Next, the printing method in Embodiment 4 will be described by using the to-be-printed object 400, the cross sections of which are schematically shown in FIGS. 10 to 13.

Figure 10:
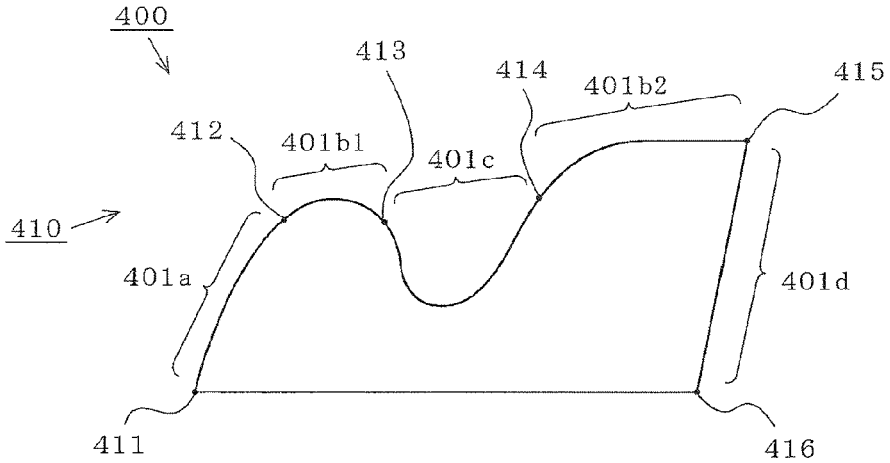
FIG. 10 shows a cross section that illustrates the printing method in FIG. 9 in individual printing processes.

In FIG. 10, the to-be-printed surface 410 (from a position 411 to a position 416) of the to-be-printed object 400 is divided into a plurality of small to-be-printed surfaces 401*a*, 401*b*1, 401*b*2, 401*c*, and 401*d* (each small to-be-printed surface may be referred to below as the small to-be-printed surface 401)(S1 in FIG. 9), and a picture 420 (not shown) to be printed on the to-be-printed surface 410 is divided into small pictures 402*a*, 402*b*1, 402*b*2, 402*c*, and 402*d* (each small picture may be referred to below as the small picture 402), each of which is printed on a pertinent small to-be-printed surface 401 (S2 in FIG. 9). The small pictures 402 are each developed into planes to form small developed pictures 403*a*, 403*b*1, 403*b*2, 403*c*, and 403*d* (each developed picture may be referred to below as the small developed picture 403) (S3 in FIG. 9).

Next, ink 404 is put on small printing original plate 430*a*, 430*b*, 430*c*, or 430*d* (hereinafter referred to as "small printing original plate 430", in some case) corresponding to the small to-be-printed surface 401 according to the small developed pictures 403 on the corresponding small to-be-printed surfaces 401 (S4 in FIG. 9). There is no limitation on the method of putting the ink 404. The ink may be putting on the convex portions of a letterpress printing plate or the concave portions of an intaglio plate on which the small developed picture 403 is formed; alternatively, the ink may be putting on a flat plate by printing (such as an ink jet printer, screen printing, gravure printing, and offset printing).

Then, small printing blankets 440*a*, 440*b*, 440*c*, and, 440*d* (each small printing blanket may be referred to below as the small printing blanket 440) corresponding to small to-be-printed surfaces 401 are pressed against the printing original plates 430, to which the small printing blankets 440 correspond, to transfer the ink 404 to the small printing blankets 440 (step S5 in FIG. 9).

Furthermore, the small printing blanket 440 is pressed against its corresponding small to-be-printed surface 401 to print the small picture 402 thereon (S6-2 in FIG. 9). Each small to-be-printed surface 401 will be described below in detail.

Figure 11:
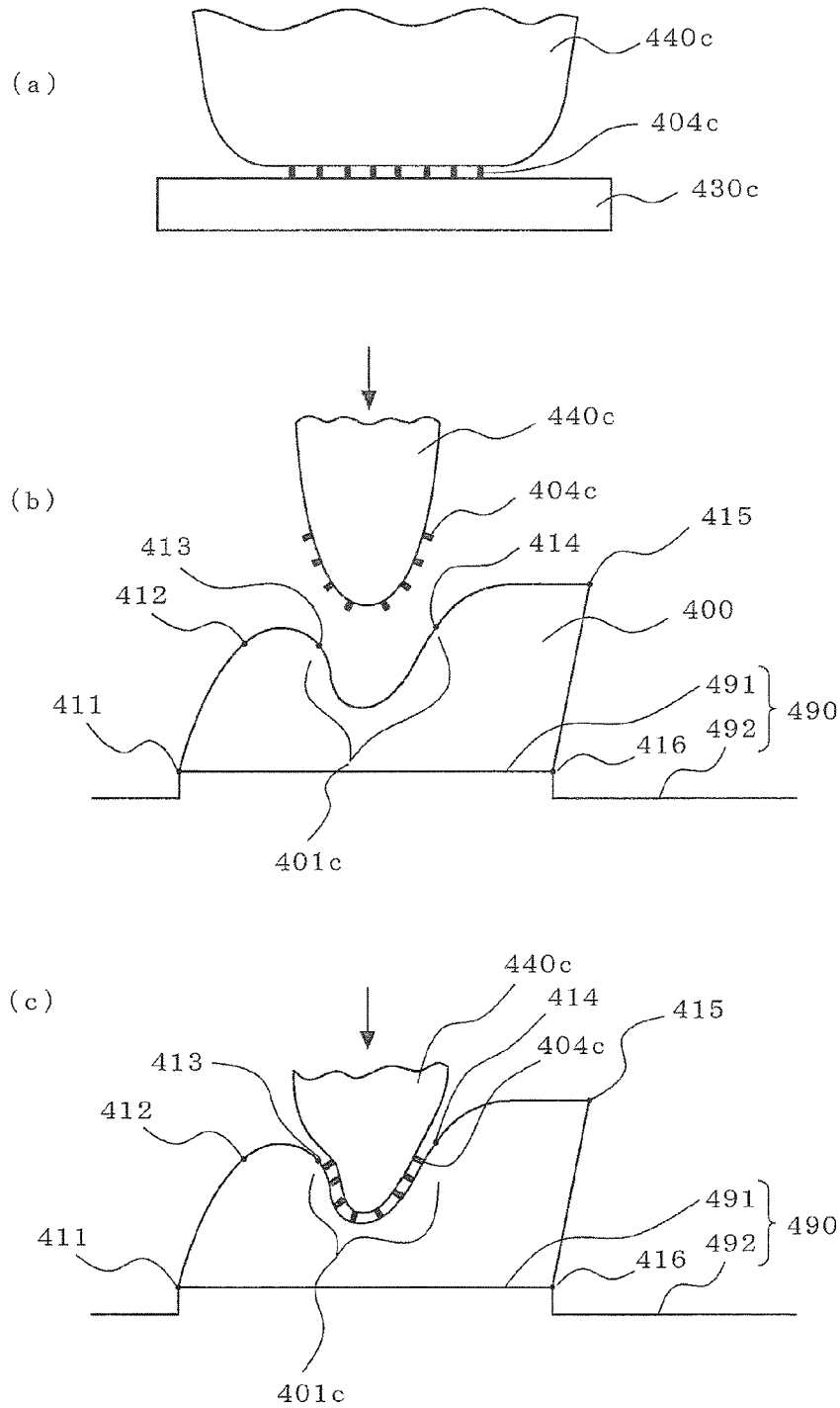
FIG. 11 shows cross sections that illustrate the printing method in FIG. 9 in individual printing processes.

In FIG. 11(*a*), ink 404*c* is putting on the small printing original plate 430*c* corresponding to the small to-be-printed surface 401*c* according to the small developed picture 403*c* (S4 in FIG. 9), and the small printing blanket 440*c* is pressed against the small printing original plate 430*c* (S5 in FIG. 9). That is, the small printing blanket 440*c* is deformed into a flat planar form, and the ink 404*c* is transferred to its surface. In the state in which the small printing blanket 440*c* is not pressed, its cross section is in a spindle-shaped state (from a substantially arc shape to a substantially parabolized state) corresponding to the shape of the small to-be-printed surface 401*c*, which has a concave shape, and the lowest point of the small printing blanket 440*c* substantially matches the center of the small developed picture 403*c*.

In FIG. 11(*b*), the to-be-printed object 400 is placed on the mounting surface 491 of a board 490. The small printing blanket 440*c* is placed immediately above its corresponding small to-be-printed surface 401*c* and lowered along the normal line of the mounting surface 491 (in the vertical direction in FIG. 11).

In FIG. 11(*c*), the small printing blanket 440*c* is pressed downwardly. Therefore, the small printing blanket 440*c* is deformed in such a way that it expands toward the surface of the small to-be-printed surface 401*c*, so the ink 404*c* is transferred to its surface and the small picture 402*c* is printed (S6-2 in FIG. 9)

In the present invention, there is no limitation on the device that presses the small printing blanket 440*c* downwardly; any type of device can be used if it can be horizontally aligned with the small to-be-printed surface 401*c*, and can grasp the small printing blanket 440*c* and move it upwardly and downwardly.

In FIG. 12(*a*), ink 404*b*1 and ink 404*b*2 are put on the small printing original plate 430*b* corresponding to the small to-be-printed surfaces 401*b*1 and 401*b*2 according to the small developed pictures 403*b*1 and 403*b*2 (S4 in FIG. 9), and the small printing blanket 440*b* is pressed against the small printing original plate 430*b* (S5 in FIG. 9). That is, the small printing blanket 440*b* is deformed into a flat planar form, and the inks 404*b*1 and 404*b*2 are transferred to their surfaces. In the state in which the small printing blanket 440*b* is not pressed, its cross section is in a substantially arc-like shape (like half a cylinder), and its lowest point substantially matches the intermediate point between the small developed picture 403*b*1 and small developed picture 403*b*2.

In FIG. 12(*b*), the to-be-printed object 400 is placed on the mounting surface 491 of the board 490. The small printing blanket 440*b* is placed immediately above its corresponding small to-be-printed surface 401*b*1 and small to-be-printed surface 401*b*2 and lowered along the normal line of the mounting surface 491 (in the vertical direction in FIG. 12).

In FIG. 12(*c*), the small printing blanket 440*b* is pressed downwardly. Therefore, the small printing blanket 440*b* is deformed in such a way that it conforms to the small to-be-printed surface 401*b*1 and small to-be-printed surface 401*b*2, the ink 404*b*1 and ink 404*b*2 are transferred to their surfaces, and the small picture 402*b*1 and small picture 402*b*2 are printed (S6-2 in FIG. 9).

There is no limitation on the device that presses the small printing blanket 440*b* downwardly, as in FIG. 11.

In FIG. 13(*a*), ink 404*a* is put on the small printing original plate 430*a* corresponding to the small to-be-printed surface 401*a* according to the small developed picture 403*a* (S4 in FIG. 9), and the small printing blanket 440*a* is pressed against the small printing original plate 430*a* (S5 in FIG. 9), That is, the small printing blanket 440*c* is deformed into a flat planar form, and the ink 404*c* is transferred to its surface. In the state in which the small printing blanket 440*a* is not pressed, its cross section is in a substantially parabolized state), and its vertex (lowest point) 441*a* is away from (deviates from) the small developed picture 403*a*.

In FIG. 13(*b*), the to-be-printed object 400 is placed on the mounting surface 491 of the board 490. The mounting surface 491 is one step higher than an abutting surface 492 around it. The vertex 441*a* of the small printing blanket 440*a* is positioned horizontally apart from its corresponding small to-be-printed surface 401*a*, and pressed downwardly along the normal line of the mounting surface 491 (in the vertical direction in FIG. 13).

In FIG. 13(*c*), the small printing blanket 440*a* is pressed against the abutting surface 492. Therefore, the small printing blanket 440*c* is deformed in such a way that its surface distant from the vertex 441*a* expands in a substantially horizontal direction, so that the small printing blanket 440*c* is pressed against the small to-be-printed surface 401*a*. That is, the ink 404*a* transferred to the small printing blanket 440*c* is transferred to the small to-be-printed surface 401 a and the small picture 402*a* is printed (S6-2 in FIG. 9).

Since the abutting surface 492 is one-step lower than the mounting surface 491, the surface, an the small printing blanket 440*c*, to which the ink 404*a* has been transfered expands more parallel to the normal line of the small to-be-printed surface 401*a* and is pressed against the small to-be-printed surface 401*a*. This improves the printing precision of the small picture 402*a*. Although the above abutting surface 492 and mounting surface 491 are mutually parallel and have a step therebetween, the abutting surface 492 may be inclined in such a way that it become lower as it approaches the mounting surface 491 (stepped part).

Although the small to-be-printed surface 401*d* is in an overhang state in which its upper side overhangs, the small picture 402*d* has been printed by a procedure similar to the procedure for the small to-be-printed surface 401*a* (the procedure for the small to-be-printed surface 401*d* is the same as the procedure for the small to-be-printed surface 401*a* if "a" assigned to the reference signs is read as referring to "d"). The range on the abutting surface 492 with which the small printing blanket 440*d* comes into contact may be inclined in such a way that it become lower as it approaches the mounting surface 491 (stepped part) so that the surface, on the small printing blanket 440*d*, to which the ink 404*d* has been transferred expands more parallel to the normal line of the small to-be-printed surface 401*d*.

(Variation 1)

FIG. 14 shows a variation of the method of printing the small picture 402*b*1 and small picture 402*b*2 illustrated in FIG. 12.

In FIG. 14(*a*), ink 404*b*1 and ink 404*b*2 are put on the small printing original plate 430*b* corresponding to the small to-be-printed surfaces 401*b*1 and 401*b*2 according to the small developed pictures 403*b*1 and 403*b*2 (S4 in FIG. 9), and small printing blanket 451*b* and small printing blanket 452*b* are respectively pressed against the small developed picture 403*b*1 and small developed picture 403*b*2 (S5 in FIG. 9).

That is, the small printing blankets 440*b* and 442*b* are deformed into a flat planar form, and the inks 404*b*1 and 404*b*2 are transferred to their surfaces. In the state in which the small printing blanket 440*b* is not pressed, its cross section is in a substantially arc shape (like a half of a cylinder), and its lowest point substantially matches the center of the small developed picture 403*b*1; in the state in which the small printing blanket 452*b* is not pressed, its cross section is in a substantially arc shape (like a half of a cylinder), and its lowest point substantially matches the center of the small developed picture 403*b*2;

In FIG. 14(*b*), the to-be-printed object 400 is placed on the mounting surface 491 of the board 490. The small printing blankets 440*b* and 452*b* are attached to a common lifting device (not shown) and pressed downwardly in the direction of the normal line of the mounting surface 491 (in the vertical direction in FIG. 14) so that they are placed immediately above their corresponding small to-be-printed surface 401*b*1 and small to-be-printed surface 401*b*2.

In FIG. 14(*c*), the small printing blankets 451*b* and 442*b* are pressed downwardly. Therefore, the small printing blankets 451*b* and 452*b* are deformed in such a way that they respectively conform to the small to-be-printed surface 401*b*1 and small to-be-printed surface 401*b*2, the ink 404*b*1 and ink 404*b*2 are transferred to their surfaces, and the small picture 402*b*1 and small picture 402*b*2 are printed (S6-2 in FIG. 9).

There is no limitation on the device that presses the small printing blankets 451*b* and 452*b* downwardly, as in FIG. 11. Although, in the above description, the ink 404*b*1 and ink 404*b*2 are put on the small printing original plate 430*b*, this is not a limitation in the invention of the application; the ink 404*b*1 and ink 404*b*2 may be put on different small printing original plates 430*b*. Although the small printing blankets

451*b* and 452*b* are attached to the common lifting device and pressed against the to-be-printed object 400 at the same time, this is not a limitation in the invention of the application; the small printing blankets 451*b* and 452*b* may be separately attached and one of them may be pressed first, (Variation 2)

FIG. 15 shows a variation of the method of printing the small picture 402*d* on the small to-be-printed surface 401*d*.

In FIG. 15(*a*), the ink 404*d* is put on the small printing original plate 430*ad* corresponding to the small to-be-printed surface 401*d* according to the small developed picture 403*d* (S4 in FIG. 9), and the small printing blanket 440*d* is pressed against the small printing original plate 430*d* (S5 in FIG. 9). That is, the small printing blanket 440*c* is deformed into a flat planar form, and the ink 404*c* is transferred to its surface.

In FIG. 15(*b*), the to-be-printed object 400 is placed on the mounting surface 491 of the board 490. The mounting surface 491 is one step higher than an abutting surface 492 around it, The vertex 441*d* of the small printing blanket 440*d* is positioned horizontally apart from its corresponding small to-be-printed surface 401*d*, and pressed downwardly along the normal line of the mounting surface 491.

In FIG. 15(*c*), the small printing blanket 440*d* is vertically pressed against the abutting surface 492 and is also moved horizontally toward the small to-be-printed surface 401*d*. Accordingly, the surface, of the small printing blanket 440*d*, that is distant from the vertex 441*d* expands and the small printing blanket 440*d* is pressed toward the small to-be-printed surface 401*d*. Therefore, the surface, on the small printing blanket 440*d*, to which the ink 404*d* has been transferred is pressed against the small to-be-printed surface 401 a from a direction closer to the normal line of the small to-be-printed surface 401*d*, so the printing precision of the small picture 402*d* is improved.

There is no limitation on the means for the horizontal movement; the means may move the to-be-printed object 400 horizontally (in the X direction and Y direction), may move the small printing blanket 440*d* (the same as for the lifting device) horizontally (in the X direction and Y direction), or may move both the to-be-printed object 400 and small printing blanket 440*d* horizontally (in the X direction and Y direction).

(Variation 3)

FIG. 16 shows a variation of the method of printing the small picture 402*d* on the small to-be-printed surface 401*d*.

FIG. 16(*a*) is identical to FIG. 15(*a*) shown in Variation 2.

In FIG. 16(*b*), the to-be-printed object 400 is placed on the mounting surface 491 of the board 490. The one-step lower abutting surface 492 and an inclined wall 493 facing the small to-be-printed surface 401*d* of the to-be-printed object 400 are formed around the mounting surface 491. Since the inclined wall 493 is spaced apart from the small to-be-printed surface 401*d* by a prescribed distance, the small printing blanket 440*d* is lowered without being brought into contact with the inclined wall 493 and small to-be-printed surface 401*d* and then the vertex 441*d* of the small printing blanket 440*d* touches its corresponding abutting surface 492 at a position horizontally distant from the small to-be-printed surface 401*d*.

In FIG. 16(*c*), when the small printing blanket 440*d* is vertically pressed against the abutting surface 492, the small printing blanket 440*d* expands. At this time, since one surface of the small printing blanket 440*d* touches the inclined wall 493 and its deformation is constrained, another surface (facing the small to-be-printed surface 401*d*) is pressed from a direction closer to the normal line of the small to-be-printed surface 401*d*. Accordingly, printing is made easy, and the printing precision of the small picture 402*d* is improved on the surface, on the small printing blanket 440*d*, to which the ink 404*d* has been transferred. There is no limitation on the shape of the inclined wall 493, and, in addition to raising and lowering, the to-be-printed object 400 and the small printing blanket 440*d* (the same as for the lifting device) may be relatively moved horizontally (in the X direction and Y direction).

An inclined wall equivalent to the inclined wall 493 may be used when the small picture 402*a* is printed on the small to-be-printed surface 401*a* (the small printing blanket 440*a* is raised and lowered).

[Embodiment 5]

Figure 17:
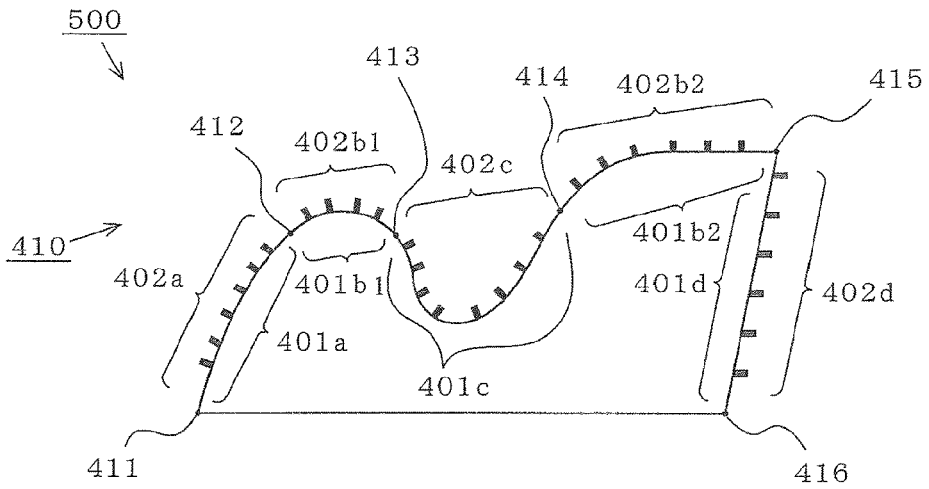
FIG. 17 schematically shows the cross section of a to-be-printed object according to Embodiment 5.

FIG. 17 schematically shows the cross section of a to-be-printed object according to Embodiment 5 of the present invention. The same parts as those in Embodiment 4 are given the same reference signs and their descriptions are partially omitted. That is, as described in Embodiment 4, the picture 420 is printed on a to-be-printed object 500 using lifting means that moves upwardly and downwardly, so the to-be-printed object 500 is inexpensively provided by a simple device.

[Embodiment 6]

Figure 18:
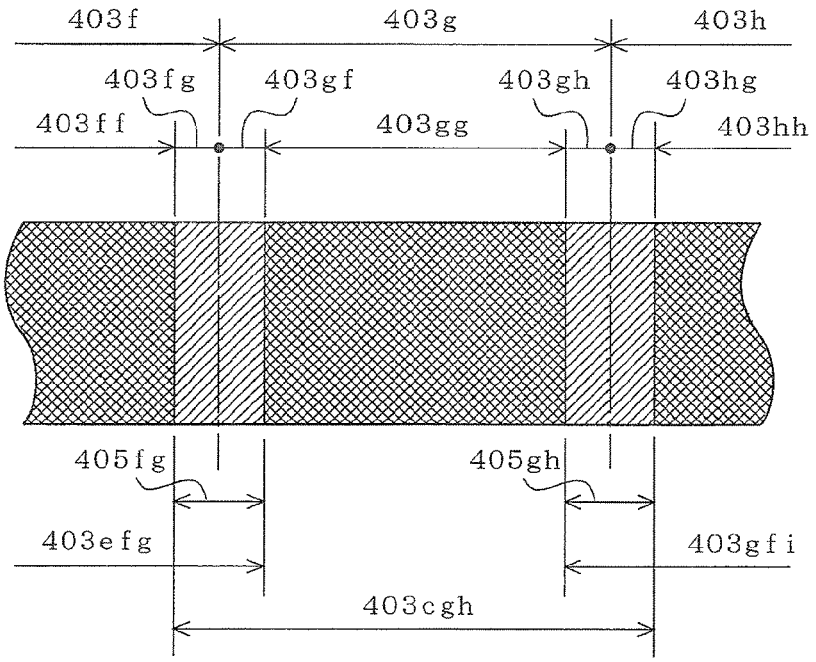
FIG. 18 shows a plan view that illustrates a procedure for dividing a picture in a printing method according to Embodiment 6 of the present invention.
Figure 19:
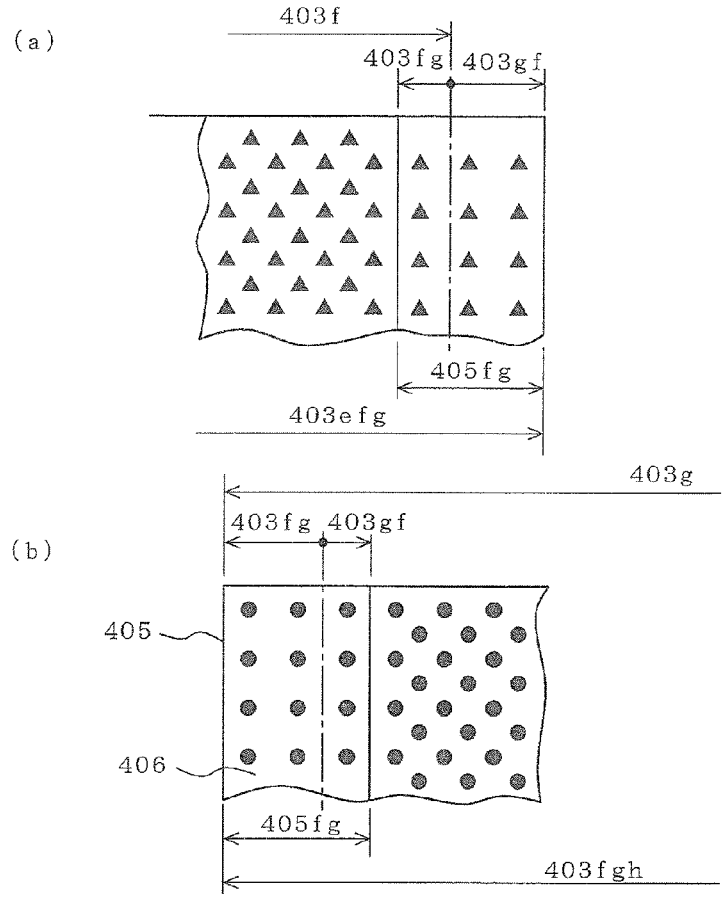
FIG. 19 shows enlarged plan views that schematically illustrate examples of halftone dot arrangements of small developed pictures in the printing method according to Embodiment 6 of the present invention.
Figure 20:
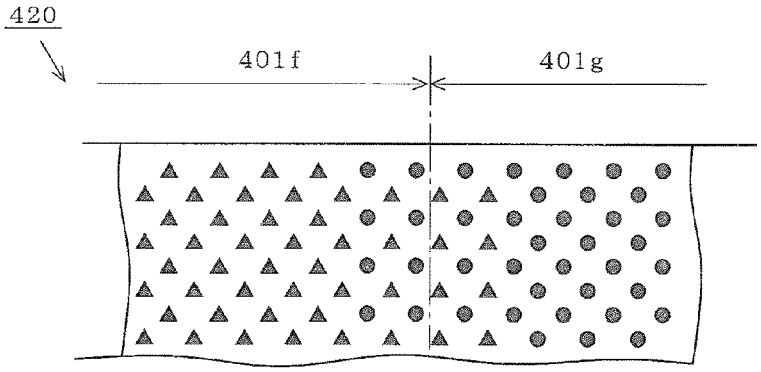
FIG. 20 shows an enlarged plan view that schematically illustrates an overlapping printed range in the printing method according to Embodiment 6 of the present invention.

FIGS. 18 to 20 illustrate a printing method according to Embodiment 6; FIG. 18 shows a plan view that illustrates a procedure for dividing a picture, FIG. 18 shows enlarged plan views that schematically illustrate examples of halftone dot arrangements of small developed pictures, and FIG. 20 shows an enlarged plan view that schematically illustrates an overlapping printed range. FIGS. 19 and 20 are schematic drawings, and the present invention is not limited in terms of the shape of the to-be-printed object and the form (shapes, distribution, and the like) of halftone dots to those shown in the drawings. The same elements as or equivalent to those in Embodiment 4 are assigned the same reference signs and their description is partially omitted.

In FIGS. 18 to 20, the to-be-printed surface 410 of the to-be-printed object 400 is divided into a plurality of small to-be-printed surfaces . . . , 401*f*, 401*g*, 401*h*, . . . so that their boundaries overlap one another with a prescribed width (equivalent to S1 in FIG. 9), and the picture 420 (not shown) to be printed on the to-be-printed surface 410 is divided into small pictures . . . , 402*f*, 402*g*, 402*h*, . . . , each of which is printed on a pertinent small to-be-printed surface 401 (equivalent to S2 in FIG. 9).

The small pictures . . . , 402*f*, 402*g*, 402*h*, . . . , are developed into planes to form small developed pictures . . . , 403*f*, 403*g*, 403*h*, . . . , (equivalent to S3 in FIG. 9).

Then, ink is put on small printing original plates . . . , 430*f*, 430*g*, 430*h*, . . . , corresponding to small to-be-printed surfaces . . . , 401*f*, 401*g*, 401*h*, . . . , according to the small developed pictures . . . , 403*f*, 403*g*, 403*h*, . . . , for the corresponding small printing original plate respectively (equivalent to S4 in FIG. 9).

At this time, ink is put on, for example, the small printing original plate 430*f* along an enlarged small developed picture 403*efg*, which is added with a boundary range 403*gf* equivalent to a prescribed width in contact with the small developed picture 403*g* of the small developed picture 403*f*, to a range equivalent to the small developed picture 403*f*.

The amount of ink to be put on an overlapping range 405*fg*, which is a combination of a boundary range 403*fg*, equivalent to a prescribed width over which the small developed picture 403*f* comes into contact with the small developed picture 403*g*, and the boundary range 403*gf*, equivalent to the prescribed width over which the small developed picture 403*g* comes into contact with the small developed picture 403*f*, is smaller than the amount of ink to be put on an inner range 403*ff*, which is obtained by excluding the overlapping range 405*fg* from a range equivalent to the enlarged small developed picture 403*efg* (see FIG. 18(*a*)).

Similarly, ink is put on, for example, the small printing original plate 430*g* according to a range equivalent to an enlarged small developed picture 403*fgh*, which is added with the boundary range 403*fg* equivalent to the prescribed width in contact with the small developed picture 403*f* of the small developed picture 403*g* and a boundary range 403*hg*, equivalent to a prescribed width over which the small developed picture 403*h* comes into contact with the small developed picture 403*g*, to a range equivalent to the small developed picture 403*g*.

The amount of ink to be put on the overlapping range 405*fg* and the amount of ink to be put on an overlapping range 405*gh*, which is a combination of a boundary range 403*gh*, equivalent to a prescribed width over which the small developed picture 403*g* comes into contact with the small developed picture 403*h*, and the boundary range 403*hg*, equivalent to the prescribed width over which the small developed picture 403*h* comes into contact with the small developed picture 403*g*, are smaller than the amount of ink to be put on an inner range 403*gg*, which is obtained by excluding the overlapping range 405*fg* and the overlapping range 405*gh* from a range equivalent to the enlarged small developed picture 403*fgh*.

That is, the number of halftone dots in, for example, the overlapping range 405*fg* is smaller than in the inner range 403*ff* and the inner range 403*gg*. Alternatively, the halftone dot distribution (the density in per unit area) in the overlapping range 405*fg* is gradually decreased as the distance from the inner range 403*ff* and the inner range 403*gg* becomes long.

Alternatively, the size of each halftone dot in the overlapping range 405*fg* is smaller than in the inner range 403*ff* and the inner range 403*gg*. Alternatively, the size of each halftone dot in the overlapping range 405*fg* is gradually decreased as the distance from the inner range 403*ff* and the inner range 403*gg* becomes long. There is no limitation on the method of putting the ink, as in Embodiment 4.

Furthermore, as in Embodiment 4, the ink is transferred to the small printing blankets . . . , 440*f*, 440*g*, 440*h*, . . . , so that the ink adheres to them along the small printing blanket pictures . . . , 404*f*, 404*g*, 404*h*, . . . , (equivalent to step S5 in FIG. 9)

Next, the small printing blankets . . . , 440*f*, 440*g*, 440*h*, . . . , are pressed against their corresponding small to-be-printed surfaces . . . , 401*f*, 401*g*, 401*h*, . . . , to print small pictures . . . , 402*f*, 402*g*, 402*h*, . . . , thereon (equivalent to S6-2 in FIG. 9).

Then, for example, the prescribed widths of the small picture 402*f* and 402*g* at their boundaries overlap each other, the prescribed widths of the small picture 402*g* and 402*h* at their boundaries overlap each other, and the amount of ink in the overlapping range is less than the amount of ink in the inner ranges, in which the overlapping range is excluded, so the picture in the overlapping range is not darkened (see FIG. 18), In this case, if, for example, the amount of ink to be put on a range equivalent to the overlapping range 405*fg* on the small developed picture 403*g* is reduced by $\alpha$% on the small printing original plate 430*f* and the amount of ink to be put on a range equivalent to the overlapping range 405*fg* on the small developed picture 403*f* is reduced by $(100-\alpha)$% on the small printing original plate 430*g*, the picture in the two overlapping ranges 405*fg* is neither darkened nor thinned, preventing the appearance from being impaired.

As described above, the present invention can carry out printing on a to-be-printed object having a complex shape, and thereby can be widely used as a printing method applicable to, for example, to-be-printed objects having concave portions.

Reference Signs List

1 small to-be-printed surface, 2 small picture, 3 small developed picture, 4 small printing blanket picture, 5 overlapping range, 10 to-be-printed surface, 20 picture, 30 small printing original plate, 40 small printing blanket, 50 arm, 100 to-be-printed object (before printing), 101 concave portion, 200 printed material (after printing), 400 to-be-printed object (in Embodiment 4), 401 small to-be-printed surface, 402 small picture, 403 small developed picture, 404 ink, 405*fg* overlapping range. 410 to-be-printed surface, 420 picture, 430 small printing original plate, 440 small printing blanket, 441 vertex, 451*b* small printing blanket, 452*b* small printing blanket, 490 board, 491 mounting surface, 492 abutting surface, 493 inclined wall, 500 to-be-printed object (in Embodiment 5).

The invention claimed is:

1. A printing method comprising the steps of:

(a) dividing a to-be-printed surface of a to-be-printed object into a plurality of small to-be-printed surfaces, including a first small to-be-printed surface and a second small to-be-printed surface having boundaries that overlap one another with a prescribed width, and dividing a picture to be printed on said to-be-printed surface into small pictures to be printed on respective of said small to-be-printed surfaces;

(b) creating a small developed picture by developing each of said small pictures into a plane;

(c) putting ink corresponding to a first of the small pictures targeted for printing on the first small to-be-printed surface on a first small printing original plate and putting ink corresponding to a second of the small pictures targeted for printing on the second small to-be-printed surface on a second small printing original plate;

(d) pressing a first small printing blanket against the first small printing original plate to transfer the ink corresponding to the first small picture to the first small printing blanket and pressing a second small printing blanket against the second small printing original plate to transfer said ink corresponding to the second small picture to the second small printing blanket; and (e) printing said first and second small pictures on respective of said first and second small to-be-printed surfaces by pressing each of said first and second small printing blankets against the first and second small to-be-printed surfaces respectively;

wherein, in step (c), the ink is put on the respective first and second small printing original plates in the form of halftone dots with a distribution density or size of the halftone dots that are targeted for an area encompassed by the overlapping boundaries being smaller than a distribution density or size of the halftone dots that are targeted for an area not encompassed by the overlapping boundaries.

2. A printing method comprising the steps of:

(a) dividing a to-be-printed surface of a to-be-printed object into a plurality of small to-be-printed surfaces, including a first small to-be-printed surface and a second small to-be-printed surface having boundaries that overlap one another with a prescribed width, and dividing a picture to be printed on said to-be-printed surface into small pictures to be printed on respective of said small to-be-printed surfaces;

(b) creating a small developed picture by developing each of said small pictures into a plane;

(c) putting ink corresponding to a first of the small pictures targeted for printing on the first small to-be-printed surface on a first small printing original plate and putting ink corresponding to a second of the small pictures targeted for printing on the second small to-be-printed surface on a second small printing original plate;

(d) pressing a first small printing blanket against the first small printing original plate to transfer the ink corresponding to the first small picture to the first small printing blanket and pressing a second small printing blanket against the second small printing original plate to transfer said ink corresponding to the second small picture to the second small printing blanket; and (e) printing said first and second small pictures on respective of said first and second small to-be-printed surfaces by pressing each of said first and second small printing blankets against the first and second small to-be-printed surfaces respectively; wherein said first and second small printing blankets are pressed against the respective first and second small printing original plates in parallel to a normal line of the respective first and second small printing original plates and are pressed against the respective first and second small to-be-printed surfaces in parallel to an average normal line of the respective first and second small to-be-printed surfaces;

wherein, in step (c), the ink is put on the respective first and second small printing original plates in the form of halftone dots with a distribution density or size of the halftone dots that are targeted for an area encompassed by the overlapping boundaries being smaller than a distribution density or size of the halftone dots that are targeted for an area not encompassed by the overlapping boundaries.

3. The printing method of claim 1, wherein the step of printing is carried out using a multi-axis robot that stores a position of each of said first and second small to-be-printed surfaces, grasps said first and second small printing blankets corresponding to each of said first and second small to-be-printed surfaces, and presses said grasped first and second small printing blankets against said first and second small to-be printed surfaces respectively.

4. The printing method of claim 1, wherein:

the step of printing is carried out using a multi-axis robot that stores a position of each of said first and second small to-be-printed surfaces, grasps said first and second small printing blankets. and presses said grasped first and second small printing blankets against said first and second small to-be-printed surfaces respectively; wherein said first small to-be-printed surface is a side face or a bottom face of a concave portion that is internally recessed in said to-be-printed object; and said first small printing blanket corresponding to said side face or said bottom face is freely intruded into said concave portion.

5. The printing method of claim 1. wherein:

the step of printing is carried out using a multi-axis robot that stores a position of each of said first and second small to-be-printed surfaces, grasps said first and second small printing blankets. and presses said grasped first and second small printing blanket against said first and second small to-be-printed surfaces respectively; wherein said first small to-be-printed surface is a side face or a bottom face of a concave portion that is internally recessed in said to-be-printed object; and a grasping part of said multi-axis robot that grasps said first small printing blanket corresponding to said side face or said bottom face is freely intruded into said concave portion.

6. A printing method comprising the steps of:

(a) dividing a to-be-printed surface of a to-be-printed object into a plurality of small to-be-printed surfaces, including a first small to-be-printed surface and a second small to-be-printed surface having boundaries that overlap one another with a prescribed width, and dividing a picture to be printed on said to-be-printed surface into small pictures to be printed on respective of said small to-be-printed surfaces;

(b) creating a small developed picture by developing each of said small pictures into a plane;

(c) putting ink corresponding to a first of the small pictures targeted for printing on the first small to-be-printed surface on a first small printing original plate and putting ink corresponding to a second of the small pictures targeted for printing on the second small to-be-printed surface on a second small printing original plate;

(d) pressing a first small printing blanket against the first small printing original plate to transfer the ink corresponding to the first small picture to the first small printing blanket and pressing a second small printing blanket against the second small printing original plate to transfer said ink corresponding to the second small picture to the second small printing blanket; and (e) printing said first and second small pictures on respective of said first and second small to-be-printed surfaces by pressing each of said first and second small printing blankets against the first and second small to-be-printed surfaces;

wherein the step of printing utilizes a lifting device that is raised and lowered with respect to a board on which said to-be-printed object is placed, and said lifting device grasps said first and second small printing blankets to press said first and second small printing blankets against the first and second small to-be-printed surfaces respectively;

wherein, in step (c), the ink is put on the respective first and second small printing original plates in the form of halftone dots with a distribution density or size of the halftone dots that are targeted for an area encompassed by the overlapping boundaries being smaller than a distribution density or size of the halftone dots that are targeted for an area not encompassed by the overlapping boundaries.

7. The printing method of claim 6, comprising operating said lifting device such that, when part of said picture is printed on the first small to-be-printed surface positioned on a side face of said to-be-printed object, said lifting device grasps said first small printing blanket and presses a part of said first small printing blanket to which ink has not been transferred against said board to press a part of said first small printing blanket to which ink has been transferred against said first small to-be-printed surface.

8. The printing method of claim 6, comprising operating said lifting device such that. when part of said picture is printed on the first small to-be-printed surface positioned on a side face of said to-be-printed object, said lifting device grasps said first small printing blanket and presses a part of said first small printing blanket to which said ink has not been transferred against said board to press a part of said first small printing blanket to which said ink has been transferred against said first small to-be-printed surface; and a range on said board against which said part of said first small printing blanket to which said ink has not been transferred is pressed is on a lowering side in an elevation direction of said lifting device within a range of said board on which said to-be-printed object is placed.

9. The printing method of claim 2, wherein the step of printing is carried out using a multi-axis robot that stores a position of each of said first and second small to-be-printed surfaces, grasps said first and second small printing blankets, and presses said grasped first and second small printing blankets against said first and second small to-be-printed surfaces respectively.

10. The printing method of claim 2, wherein:

the step of printing is carried out using a multi-axis robot that stores a position of each of said first and second small to-be-printed surfaces, grasps said first and second small printing blankets, and presses said grasped first and second small printing blankets against said first and second small to-be-printed surfaces respectively; wherein said first small to-be-printed surface is a side face or a bottom face of a concave portion that is internally recessed in said to-be-printed object; and said first small printing blanket corresponding to said side face or said bottom face is freely intruded into said concave portion.

11. The printing method of claim 2, wherein:

the step of printing is carried out using a multi-axis robot that stores a position of each of said first and second small to-be-printed surfaces, grasps said first and second small printing blankets, and presses said grasped first and second small printing blankets against said first and second small to-be-printed surfaces respectively; wherein said first small to-be-printed surface is a side face or a bottom face of a concave portion that is internally recessed in said to-be-printed object; and a grasping part of said multi-axis robot that grasps said first small printing blanket is freely intruded into said concave portion.

12. The printing method of claim 1, wherein in step (c), the ink is put on each of the respective first and second small printing original plates such that a distribution density of the halftone dots that are targeted for the area encompassed by the overlapping boundaries is smaller than a distribution density of the halftone dots that are targeted for the area not encompassed by the overlapping boundaries.

13. The printing method of claim 1, wherein in step (c), the ink is put on each of the respective first and second small printing original plates such that a size of the halftone dots that are targeted for the area encompassed by the overlapping boundaries is smaller than a size of the halftone dots that are targeted for the area not encompassed by the overlapping boundaries.

14. The printing method of claim 2, wherein in step (c), the ink is put on each of the respective first and second small printing original plates such that a distribution density of the halftone dots that are targeted for the area encompassed by the overlapping boundaries is smaller than a distribution density of the halftone dots that are targeted for the area not encompassed by the overlapping boundaries.

15. The printing method of claim 2, wherein in step (c), the ink is put on each of the respective first and second small printing original plates such that a size of the halftone dots that are targeted for the area encompassed by the overlapping boundaries is smaller than a size of the halftone dots that are targeted for the area not encompassed by the overlapping boundaries.

16. The printing method of claim 6, wherein in step (c), the ink is put on each of the respective first and second small printing original plates such that a distribution density of the halftone dots that are targeted for the area encompassed by the overlapping boundaries is smaller than a distribution density of the halftone dots that are targeted for the area not encompassed by the overlapping boundaries.

17. The printing method of claim 6, wherein in step (c), the ink is put on each of the respective first and second small printing original plates such that a size of the halftone dots that are targeted for the area encompassed by the overlapping boundaries is smaller than a size of the halftone dots that are targeted for the area not encompassed by the overlapping boundaries.

18. The printing method of claim 1, wherein each of the first and second small printing blankets is deformable such that the first and second small printing blankets (i) conform to a shape of the first small printing original plate and a shape of the second small printing original plate respectively when pressed against the respective first and second small original plates in step (d), and (ii) conform to a shape of the first small to-be-printed surface and second small to-be-printed surface respectively when pressed against the respective first small to-be-printed surface and second small to-be-printed surface in step (e), and wherein each of the first and second small printing blankets has an original shape to which it returns after being deformed in steps (d) and (e).

19. The printing method of claim 2, wherein each of the first and second small printing blankets is deformable such that the first and second small printing blankets (i) conform to a shape of the first small printing original plate and a shape of the second small printing original plate respectively when pressed against the respective first and second small original plates in step (d), and (ii) conform to a shape of the first small to-be-printed surface and second small to-be-printed surface respectively when pressed against the respective first small to-be-printed surface and second small to-be-printed surface in step (e), and wherein each of the first and second small printing blankets has an original shape to which it returns after being deformed in steps (d) and (e).

20. The printing method of claim 6, wherein each of the first and second small printing blankets is deformable such that the first and second small printing blankets (i) conform to a shape of the first small printing original plate and a shape of the second small printing original plate respectively when pressed against the respective first and second small original plates in step (d), and (ii) conform to a shape of the first small to-be-printed surface and second small to-be-printed surface respectively when pressed against the respective first small to-be-printed surface and second small to-be-printed surface in step (e), and wherein each of the first and second small printing blankets has an original shape to which it returns after being deformed in steps (d) and (e).

* * * * *